US012140367B2

(12) United States Patent
Lazar et al.

(10) Patent No.: US 12,140,367 B2
(45) Date of Patent: Nov. 12, 2024

(54) COOLER CONTAINER

(71) Applicant: Keter Plastic Ltd., Herzliya (IL)

(72) Inventors: Adva Lazar, Oshrat (IL); Shimrit Weiss, Emek HaMaayanot (IL)

(73) Assignee: KETER HOME AND GARDEN PRODUCTS LTD, Herzliya (IL)

( * ) Notice: Subject to any disclaimer, the term of this patent is extended or adjusted under 35 U.S.C. 154(b) by 413 days.

(21) Appl. No.: 17/446,372

(22) Filed: Aug. 30, 2021

(65) Prior Publication Data

US 2022/0065519 A1 Mar. 3, 2022

Related U.S. Application Data

(60) Provisional application No. 63/072,535, filed on Aug. 31, 2020.

(51) Int. Cl.

| | |
|---|---|
| ***F25D 23/06*** | (2006.01) |
| ***F25D 17/04*** | (2006.01) |
| ***F25D 17/06*** | (2006.01) |

(52) U.S. Cl.
CPC ..... *F25D 17/065* (2013.01); *F25D 17/045* (2013.01); *F25D 23/06* (2013.01); *F25D 2317/061* (2013.01); *F25D 2400/10* (2013.01)

(58) Field of Classification Search
CPC ..... F25D 17/045; F25D 11/02; F25D 17/065
See application file for complete search history.

(56) References Cited

U.S. PATENT DOCUMENTS

| | | | | |
|---|---|---|---|---|
| 3,971,231 | A | 7/1976 | Derry | |
| 6,419,088 | B1 * | 7/2002 | Barrois | B65D 25/107 206/570 |
| 6,895,778 | B1 | 5/2005 | Ackerman | |
| 8,931,293 | B2 * | 1/2015 | Shei | A47J 36/2483 219/385 |
| 9,303,912 | B1 * | 4/2016 | Schalla | A47B 31/02 |
| 10,307,761 | B2 * | 6/2019 | Schryver | B01L 7/50 |
| 10,443,918 | B2 * | 10/2019 | Li | F25D 3/08 |
| 10,823,477 | B2 * | 11/2020 | Bessho | F25D 11/006 |
| 10,906,723 | B2 * | 2/2021 | Guerdrum | B65D 45/20 |
| 11,242,175 | B2 * | 2/2022 | Barfoot | B65D 81/3818 |
| 11,643,213 | B2 * | 5/2023 | Moran | B64D 13/00 244/118.5 |
| 2006/0218963 | A1 | 10/2006 | Elias | |
| 2007/0186579 | A1 | 8/2007 | Barker | |

(Continued)

FOREIGN PATENT DOCUMENTS

| | | | |
|---|---|---|---|
| DE | 295 80 117 | U1 | 12/1996 |
| JP | 2005-104567 | A | 4/2005 |
| WO | 2017/186502 | A1 | 11/2017 |

*Primary Examiner* — Filip Zec
(74) *Attorney, Agent, or Firm* — Vorys, Sater, Seymour and Pease LLP; Anthony P. Venturino; Maryellen Feehery Hank

(57) ABSTRACT

A storage container having a basin defining an interior space, and comprising two or more partition walls; a freezer partition wall defining a freezer compartment, a chill partition wall defining a chilled compartment, a cooling chamber being defined between said partition walls, wherein each of said partition walls are configured, when a cooling medium is received within said cooling chamber, for allowing airflow therethrough to its respective compartment, thereby maintaining a temperature difference between said freezer compartment and chilled compartment.

17 Claims, 21 Drawing Sheets

(56) References Cited

U.S. PATENT DOCUMENTS

| | | | | |
|---|---|---|---|---|
| 2015/0007600 | A1* | 1/2015 | Godecker | F25D 17/06 62/419 |
| 2015/0028157 | A1* | 1/2015 | Hoogeveen | B64D 11/04 244/118.1 |
| 2015/0059363 | A1* | 3/2015 | Burd | B62B 5/0447 62/3.62 |
| 2015/0289643 | A1* | 10/2015 | Holtorf | B64D 11/04 165/41 |
| 2015/0314874 | A1* | 11/2015 | Burgess | F25D 11/003 29/890.035 |
| 2017/0073147 | A1 | 3/2017 | Kuhn | |
| 2017/0307278 | A1 | 10/2017 | Chandran et al. | |
| 2018/0016060 | A1 | 1/2018 | Peach et al. | |
| 2021/0053725 | A1 | 2/2021 | Barfoot et al. | |

* cited by examiner

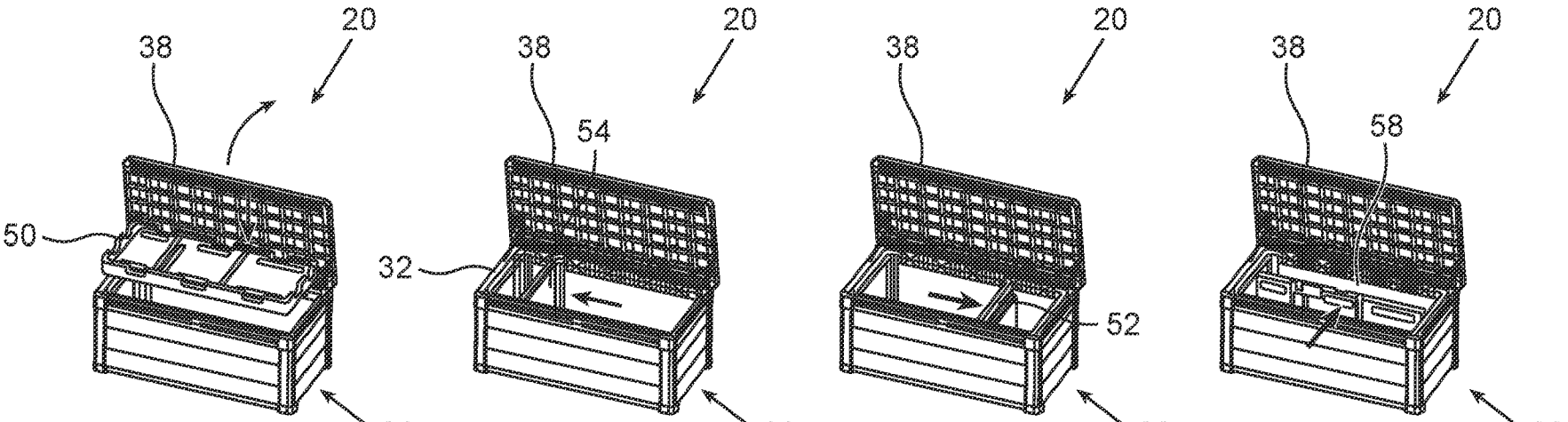
Fig. 9.1
Fig. 9.2
Fig. 9.3
Fig. 9.4
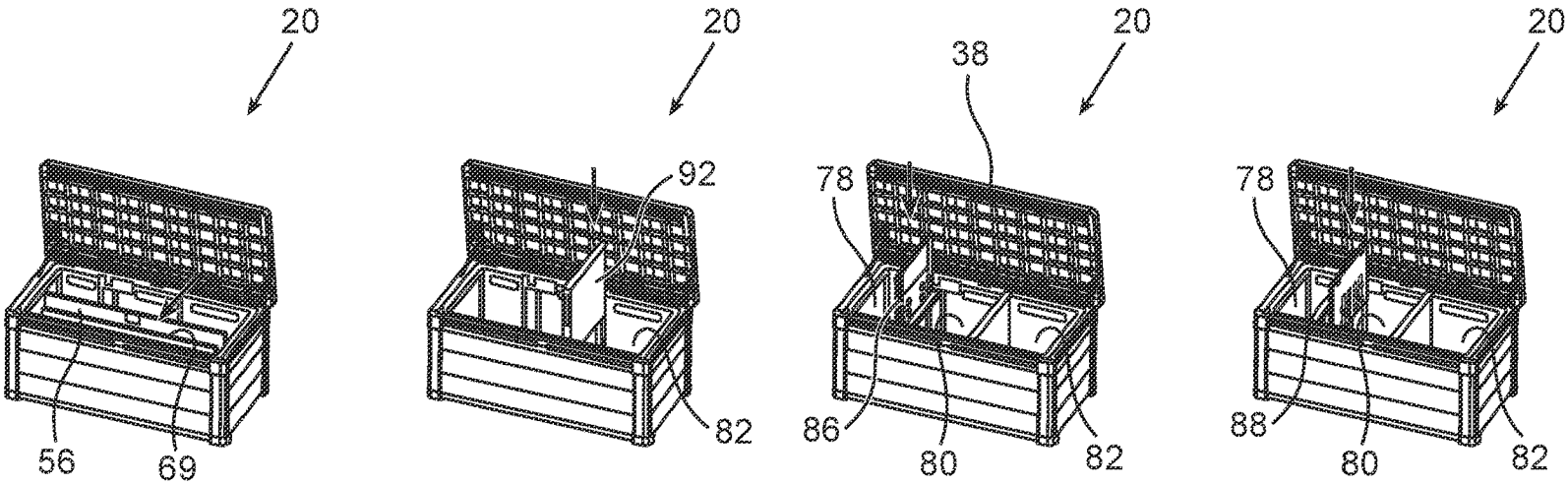
Fig. 9.5
Fig. 9.6
Fig. 9.7
Fig. 9.8

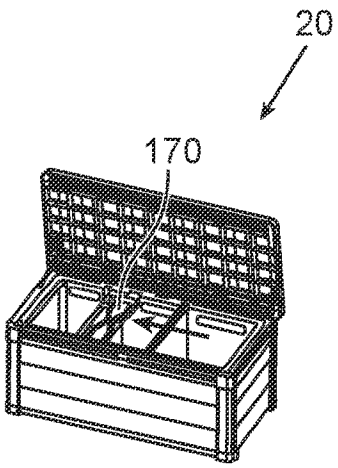
Fig. 9.12
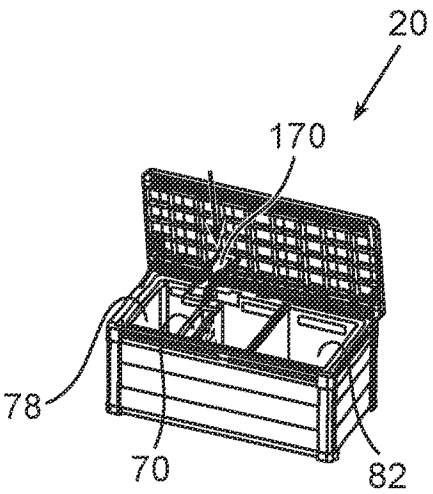
Fig. 9.11
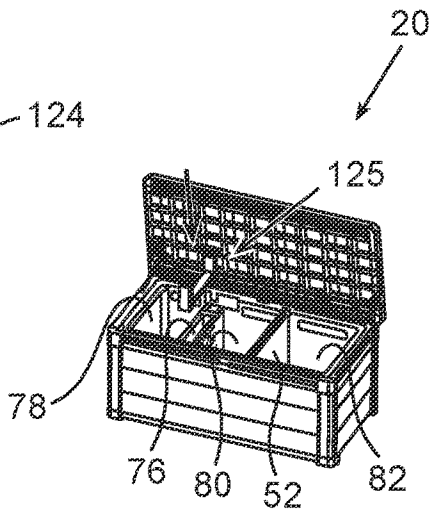
Fig. 9.10
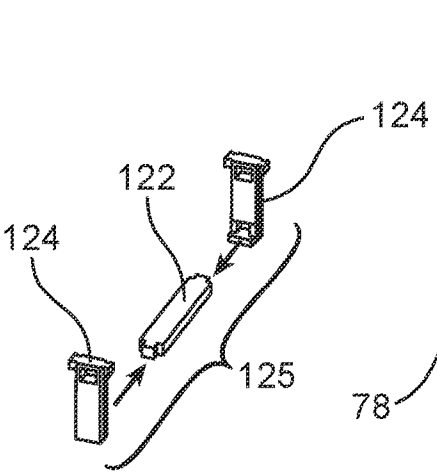
Fig. 9.9
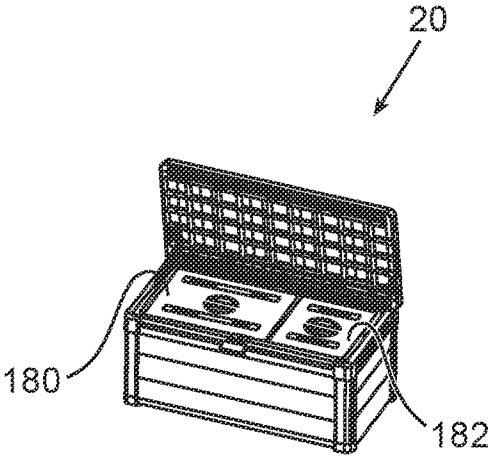
Fig. 9.14
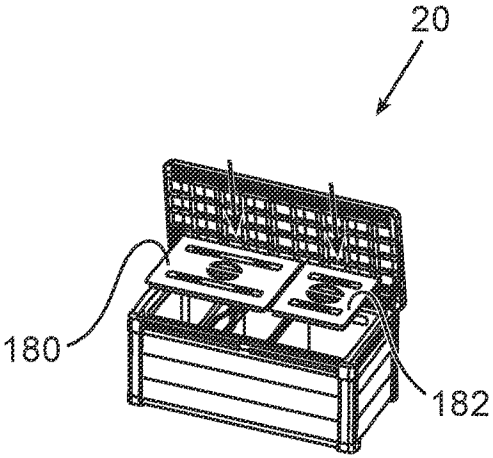
Fig. 9.13

COOLER CONTAINER

TECHNOLOGICAL FIELD

The presently disclosed subject matter relates to storage containers, and in particular to containers configured for keeping items stored therewithin at low temperatures.

BACKGROUND ART

References considered to be relevant as background to the presently disclosed subject matter are listed below:

U.S. Pat. No. 3,971,231

US2017307278

JP2005104567

Acknowledgement of the above references herein is not to be inferred as meaning that these are in any way relevant to the patentability of the presently disclosed subject matter.

BACKGROUND

U.S. Pat. No. 3,971,231 discloses a refrigerator incorporating an insulated cabinet having an access opening and a door normally closing said opening with at least one dry ice carrier removably disposed in said cabinet in alignment with said access opening. Said dry ice carrier takes the form of a container having a solid side and a perforated side and of a size and shape enabling the dry ice carrier to be positioned at one side of said insulated cabinet or transversely thereof as desired.

US2017307278 discloses a delivery container suitable to deliver multiple items that require storage at different temperatures for the duration of the delivery. The delivery container may be a cube or a rectangular prism constructed of an insulating material. The delivery organization may position a central panel in the delivery container to separate two compartments of the delivery container, each compartment to be cooled to a different temperature than the other. The delivery organization determines an appropriate coolant for each compartment based on heat transfer requirements of the compartment and positions the coolant in the bottom of each respective compartment. A panel is placed over each coolant and the items are placed in the appropriate compartments of the delivery container. A top panel is positioned on the delivery container to seal the delivery container.

JP2005104567 discloses a cold-keeping container comprising a container main body which can be divided into two or more divisions having different cold-keeping temperatures, and a lid body. The thickness of either one or all of the side wall and the bottom surface of the container main body of the lower-temperature side division, and the lid body is made larger. At the same time, the cold-keeping container is constituted in such a manner that a bulkhead for dividing the container into the lower-temperature side division and the higher-temperature side division may be provided. In addition, the bulkhead is made attachable to and detachable from the container main body of the cold-keeping container having multiple divisions while being the cold-keeping container comprising the container main body which can be divided into two or more divisions having different cold-keeping temperatures, and the lid body.

GENERAL DESCRIPTION

According to the present disclosure there is a storage container configured with at least two thermally insulated compartments with a cooling chamber disposed between said compartments, wherein partition walls of said cooling chamber are configured for admitting controlled airflow between said cooling chamber and the compartments.

The disclosure is directed to a storage container having a basin defining an interior space, and comprising two or more partition walls; a freezer partition wall defining a freezer compartment, a chill partition wall defining a chilled compartment, a cooling chamber being defined between said partition walls, wherein each of said partition walls are configured, when a cooling medium is received within said cooling chamber, for allowing airflow therethrough to its respective compartment, thereby maintaining a temperature difference between said freezer compartment and chilled compartment.

The term cooling chamber can is interchangeable used and understood as cooling compartment.

According to a specific configuration of the disclosure the storage container is configured for receiving within a housing container, said housing container configured with solid side walls and a lid, and wherein said lid admits access to removable covers of the storage container.

According to a specific configuration, there is a storage container having a basin defining a thermally insulated interior space, and comprising a freezer compartment and a chilled compartment with a cooling chamber disposed intermediate said freezer compartment and said chilled compartment, and an ambient compartment neighboring said chilled compartment with an ambient partition wall disposed therebetween; wherein the cooling chamber comprises a freezer partition wall facing the freezer compartment and a chill partition wall facing the chilled compartment, wherein said freezer partition wall and said chill partition wall are configured, when a cooling medium is received within said cooling chamber, for allowing directional airflow therethrough to its respective compartment, thereby maintaining a temperature difference between said freezer compartment and said chilled compartment.

The cooling chamber is configured for receiving cooling medium therein, wherein when received within the cooling chamber, said cooling medium disperses cold air flow through refrigerator apertures configured at the freezer partition wall and at the chill partition wall.

According to an aspect of the disclosure there is a cooler container assembly comprising a housing container and a storage container configurable for receiving within the housing container, wherein said housing container is configured with solid side walls and a lid; said storage container having a basin defining an interior space, and comprising two or more partition walls; a freezer partition wall defining a freezer compartment, a chill partition wall defining a chilled compartment, a cooling chamber being defined between said partition walls, wherein each of said partition walls are configured, when a cooling medium is received within said cooling chamber, for allowing airflow therethrough to its respective compartment, thereby maintaining a temperature difference between said freezer compartment and chilled compartment, and where the lid admits access to the removable covers of the storage container.

According to an embodiment of the disclosure, the storage container is composed of external walls comprising a base member, a right side wall, a left side wall, a front wall a back wall, at least one removable cover, wherein said external walls and said at least one removable cover and said partition walls are made of a thermally insulating material.

According to a specific embodiment of the disclosure, the base member, and the walls of the storage container and at least the freezer partition wall and the chill partition wall are configured for foolproof assembly, such that they can be assembled only at a pre-designed configuration.

Another aspect of the disclosure is directed to a cooler container kit comprising a housing container configured with solid side walls and a lid, and said a elements for assembling a storage container snugly receivable with said housing container, said storage container comprising a freezer partition wall, a chill partition wall, a cooling chamber for receiving a cooling medium, said partition walls configured for allowing airflow therethrough to neighboring compartment, thereby maintaining a temperature difference between a freezer compartment and a chilled compartment, and where the lid admits access to the removable covers of the storage container.

Any one or more of the following features, designs and configurations, can be associated with a cooler container, according to any of its embodiments, at any one or more of the following features, separately or in various combinations thereof:

The housing container can be made of rigid material e.g. Polypropylene;

At least some of the walls of the housing container can be made of multi-layer, reinforced boards;

Portions of the housing container can be reinforced by metal bars;

The housing container can be a closable and lockable container;

The housing container can be configured with a locking mechanism for admitting authorized opening thereof;

The locking mechanism can be a smart lock;

The locking mechanism can be remotely controlled;

The external walls and said at least one removable cover and said partition walls are made of a thermally insulating material such as expanded polypropylene (EPP);

The storage container is configured for foolproof assembly, and wherein visible indicia is provided for confirming correct assembly;

At and assembled position the storage container fits tight within the housing container;

The cooling chamber comprises a top cover extending over at least a portion of a cooling chamber space, defined between the freezer partition wall, and the chill partition wall and a cooling medium support within said cooling chamber;

The top cover of the cooling chamber can be configured with a child-proof arrangement, so as to prevent or reduce the likelihood of a child displacing the top cover between an open position at which the top cover can be opened to facilitate access into cooling chamber space, and a closed position;

the interior space is accessible through a top opening or an opening at any one of upwardly extending walls of the storage container;

The child-proof arrangement of the top cover can be a sliding path configured at an inside face of the front wall and the back wall of the storage container;

The cooling medium can be one or more packs of dried ice;

The cooling medium can be ice;

The cooling medium can be an active cooling unit articulated to a power source;

The cooling medium support within the cooling chamber can extend spaced apart from the base member of the storage container;

The cooling chamber can be configured with one or two lateral flow paths, extending between a bottom space below the cooling medium support, and a top portion, above the cooling medium support;

A space below the cooling medium support can be configured with air flow apertures, facilitating air flow between the freezer compartment and the chilled compartment;

The refrigerator apertures configured at the freezer partition wall and at the chill partition wall are shaped and sized for child safety, such that a child can not introduce fingers through said refrigerator apertures;

The refrigerator apertures are throughgoing slots;

At least some of the refrigerator apertures are throughgoing with a frustoconical cross section, wherein refrigerator apertures at the freezer partition wall have a wide opening at a low temperature zone and a narrow opening at a high temperature zone;

The frustoconical cross section shape of the refrigerator apertures is configured for air circulation, wherein cold airflow takes place in direction from a narrow opening towards a wider opening;

When a cooling medium is received within the cooling chamber the cooling chamber is a lower-most, sub-zero temperature zone (T° Cc); the freezer compartment is configured as a sub-zero temperature zone (T° Fc); the chilled compartment is configured as a chilled temperature zone (T° CHc); and the ambient compartment is configured as an ambient temperature zone (T° Ac); wherein T° Cc<T° Fc<T° CHc<T° Ac;

According to a particular example, the freezer compartment is configured for holding a temperature (T° Fc) of about (−16° C.) for about 6 hours;

According to a particular example, the chilled compartment is configured for holding a temperature (T° CHc) of between about (0° C.) to (5° C.) for about 6 hours;

The ambient compartment is configured for maintaining a steady temperature (T° Ac), insulated from ambient temperature, for about 6 hours;

The ambient partition wall can be configured with throughgoing apertures configured for air circulation between the chilled compartment and the ambient compartment;

The apertures extending through the ambient partition wall can be configured at a top portion of the ambient partition wall;

The apertures extending through the ambient partition wall can have a uniform cross section;

An opening of the refrigerator apertures, at one or both of the freezer partition wall and the chill partition wall, at an inside face thereof of the cooling chamber space, and/or at an inside face of the freezer compartment and at an inside face the chilled compartment, respectively, can be spaced from a surface of the respective wall surface, thereby facilitating air flow albeit an obstacle disposed in front of the opening;

The cooling medium support within said cooling chamber can be configured with refrigerator apertures extending between the cooling chamber space towards the space below the cooling medium support, facilitating air flow in direction from the cooling chamber space towards said space below the cooling medium support;

The interior space can be coverable by one or more removable covers, each cover configured for removable covering one or more of the thermally insulated compartments and the cooling chamber;

According to a particular example, a first removable cover is configured over the freezer compartment and over the chilled compartment, with the cooling chamber disposed intermediate, and a second removable cover is configured over the ambient compartment;

The storage container can comprise one or more removable covers for covering any one or more of the freezer compartment and the chilled compartment and the cooling chamber and the ambient compartment;

A bottom face of the one or more removable covers is configured with a position rim for positioning within a top portion of the interior space;

The position rim can be configured with a tapering cross-section;

A top face of the one or more removable covers is configured with indicia representing the compartment below;

The housing container can be configured with a lid support mechanism, configured for supporting the lid at an open position;

The walls of the container can be assembled over the base member at a preset arrangement, by a foolproof arrangement, wherein mating edges of the walls and the base member comprise one or more projections configured at one or both of the walls and the base member, and the other one or both of the walls and the base member comprises respective indentions, in register with the projections and configured for unidirectional true positioning of said walls over the base member;

Any one or more of the front wall and the back wall and the base member of the storage container can be configured with a foolproof assembly arrangement, configured for unidirectional, true positioning, of the cooling chamber within the interior space;

A top face of the base member of the storage container can be configured with depressions and/or projections disposed in register with opposite ones of depressions and/or projections configured at a bottom edge of a partition wall;

One or both of the front wall and the back wall of the storage container can be configured with recesses, each configured for selectively receiving therein a designated partition wall;

Any one or more of the partition walls can be configured at a bottom edge thereof with depressions and/or projections disposed in register with opposite ones of depressions and/or projections configured at a bottom edge of the base wall;

Any one or more of the partition walls can be configured at one or both side edges thereof with lateral projections configured for selectively receiving within a designated recesses configured at a front wall and a back wall of the storage container;

The storage container can be configured as a readily knock-down assembly;

The storage container can be configured with temperature measuring and temperature indicators, for indicating and possibly alerting regarding temperature within the compartments The partition walls can be made of thermally insulating material;

The thickness of the partition walls depends of thermal properties thereof.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIGS. 9.1 to 9.14 are perspective views illustrating consecutive steps of assembling a cooler container assembly according to the disclosure;

DETAILED DESCRIPTION OF EMBODIMENTS

Figure 1B:
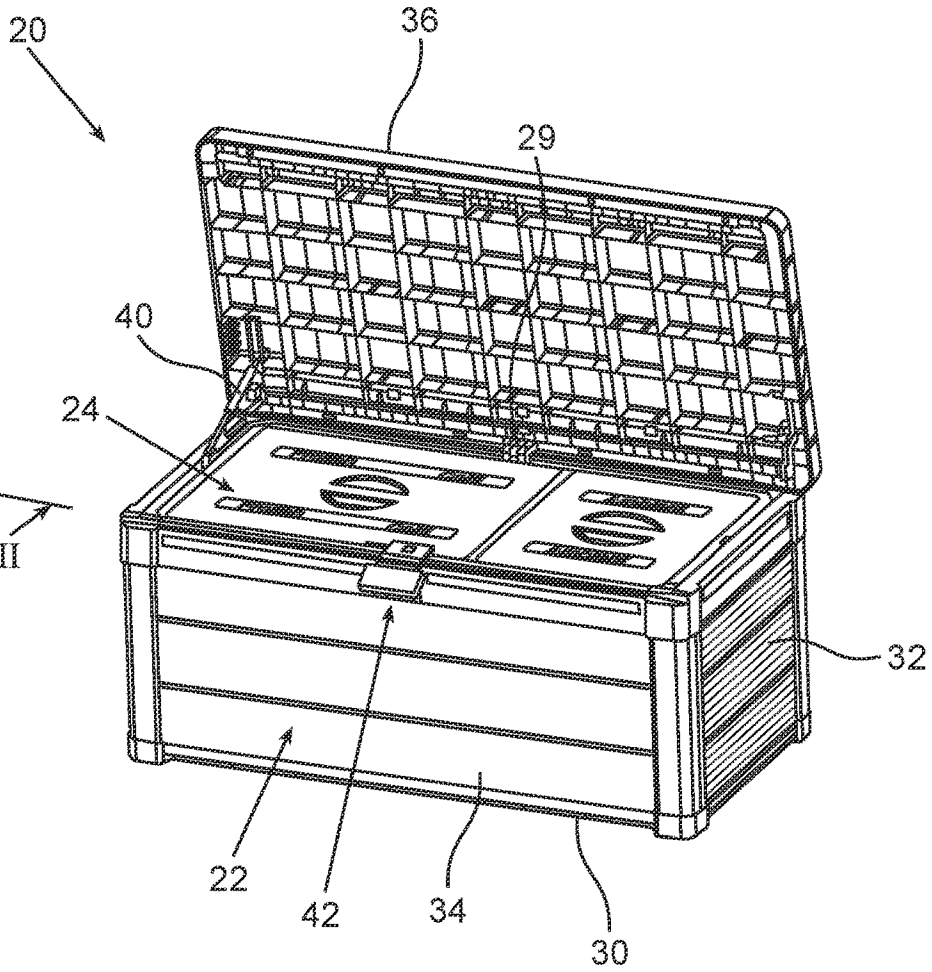
FIG. 1B illustrates the cooler container reassembly of FIG. 1A with a lid at an open position.
Figure 1A:
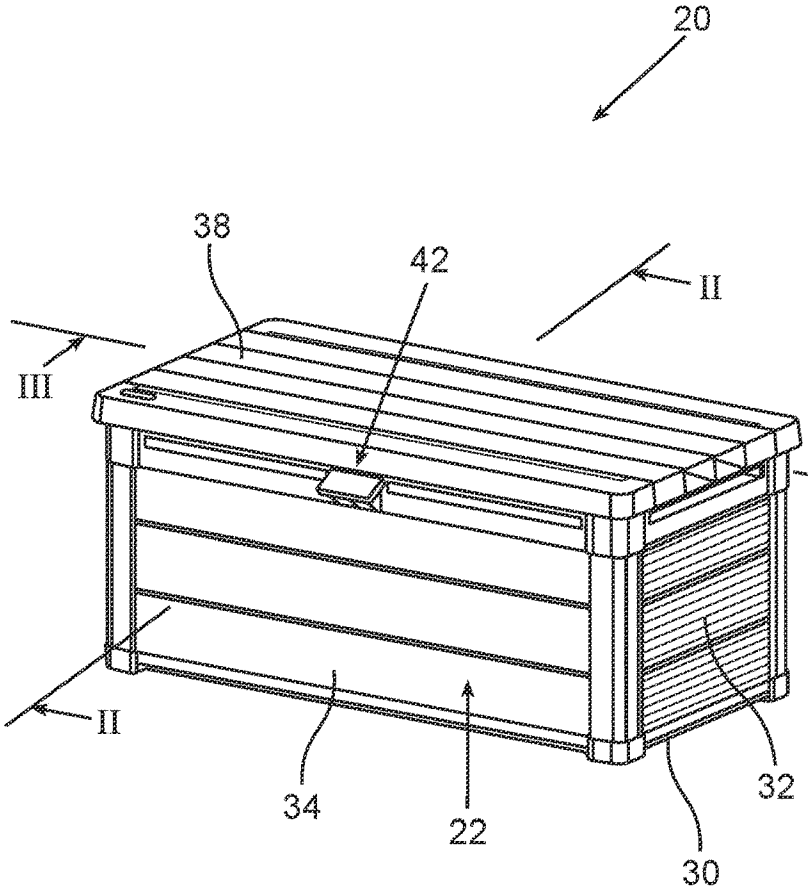
FIG. 1A is a perspective view of a cooler container reassembly according to an aspect of the disclosure.
Figure 2B:
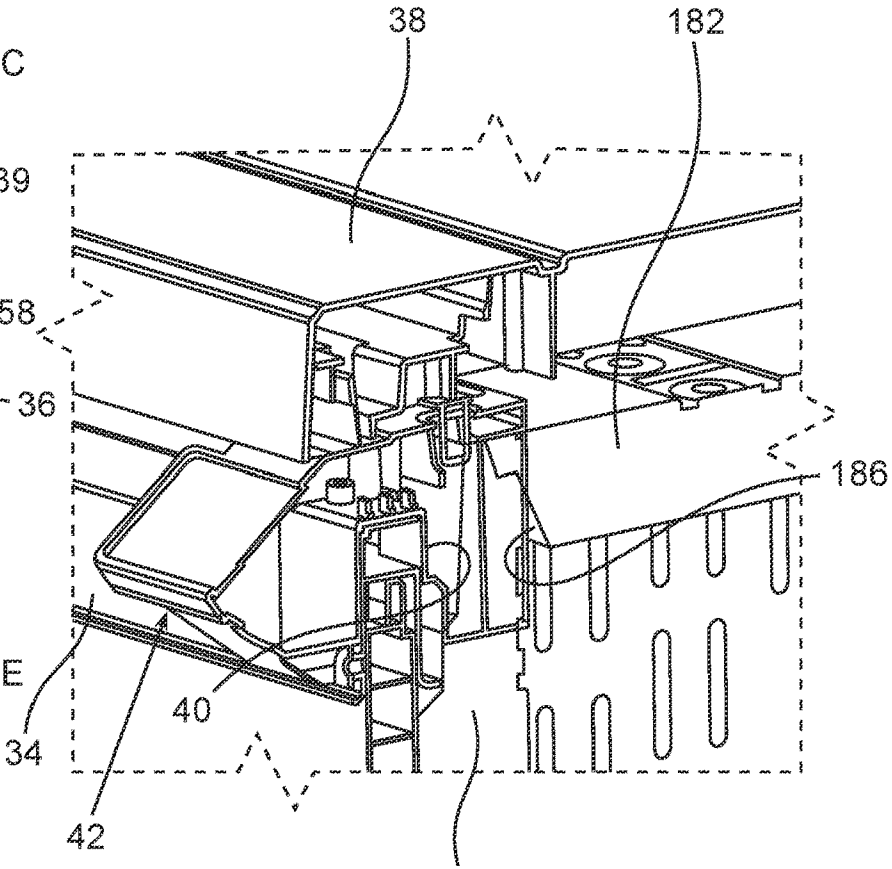
FIG. 2B is an enlargement of the portion marked 2B in FIG. 2A.
Figure 2A:
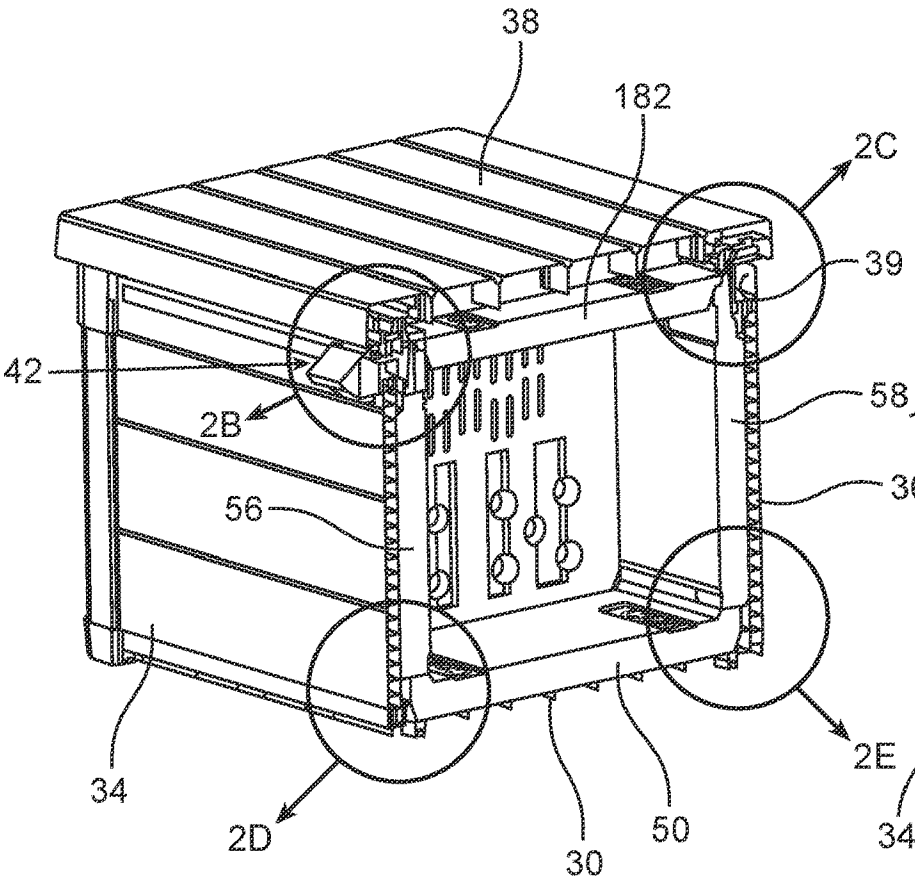
FIG. 2A is a vertical section taken along line II-II in FIG. 1A.
Figure 2D:
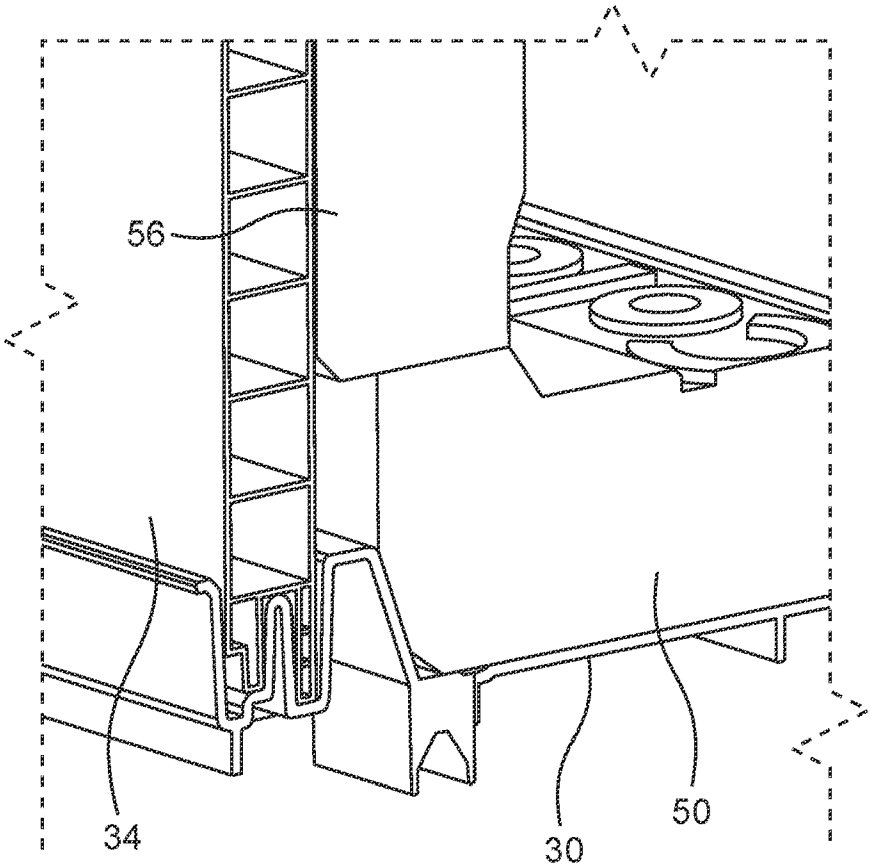
FIG. 2D is an enlargement of the portion marked 2D in FIG. 2A.
Figure 2C:
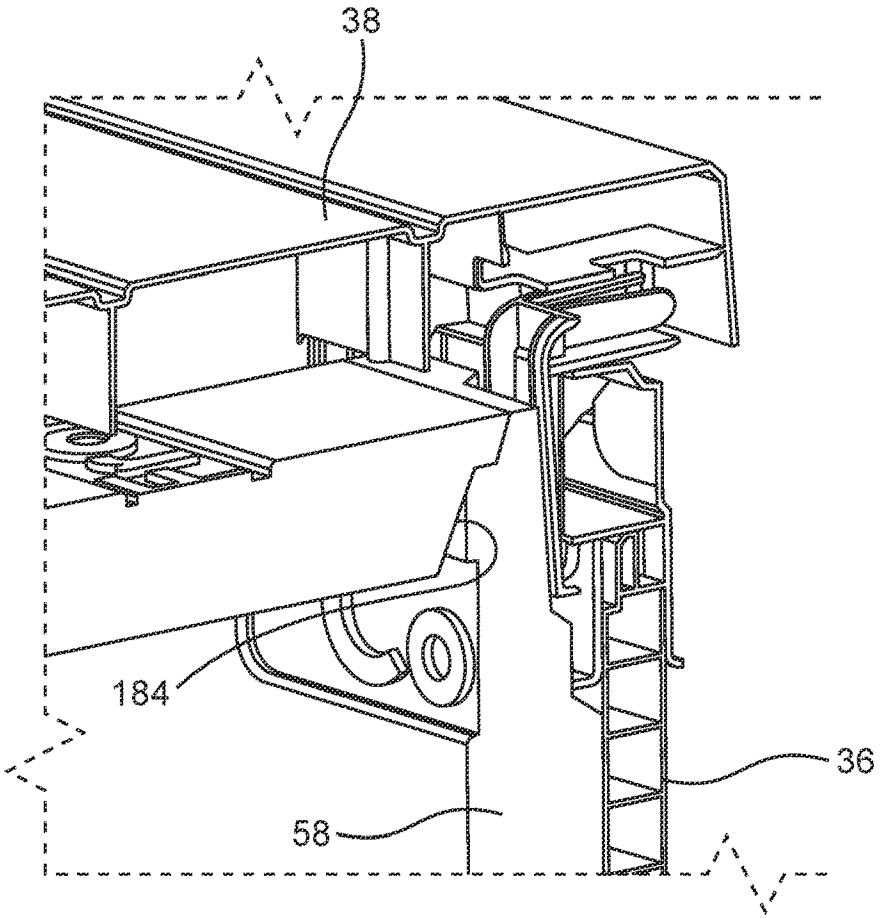
FIG. 2C is an enlargement of the portion marked 2C in FIG. 2A.
Figure 3:
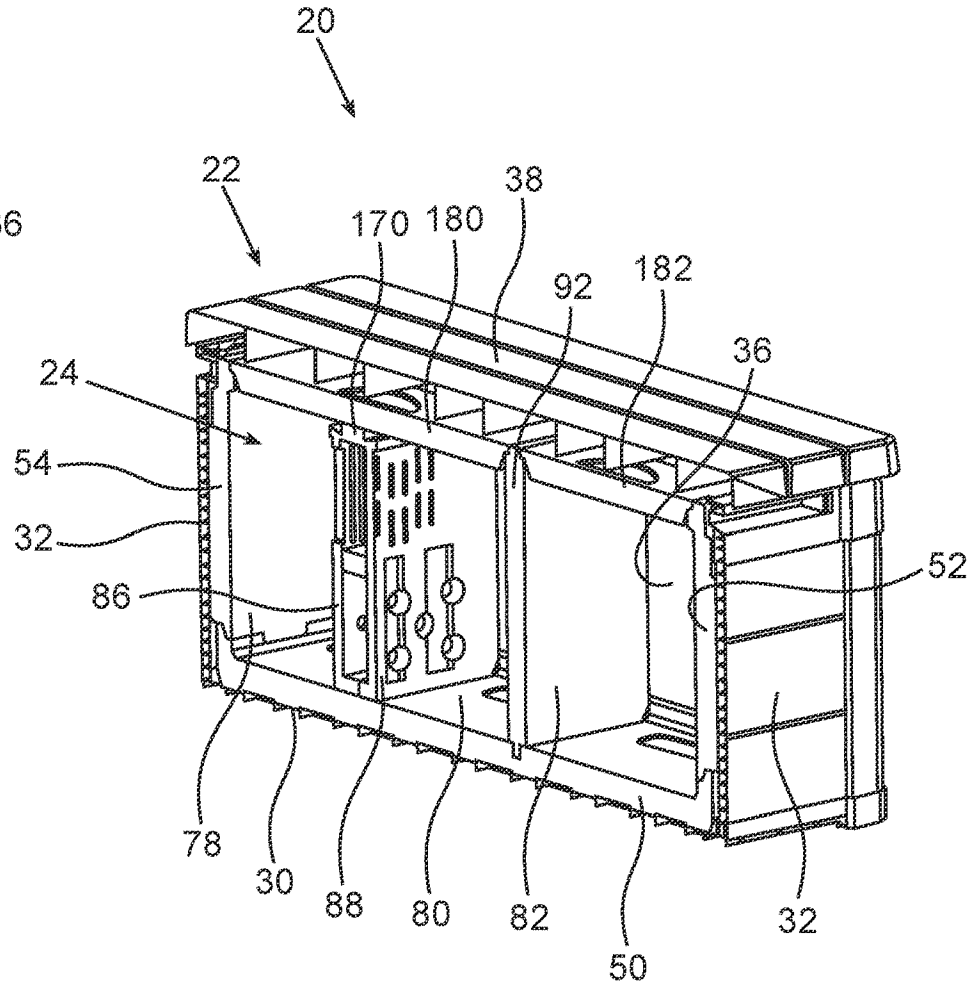
FIG. 3 is a vertical section taken along line III-III in FIG. 1A.
Figure 2E:
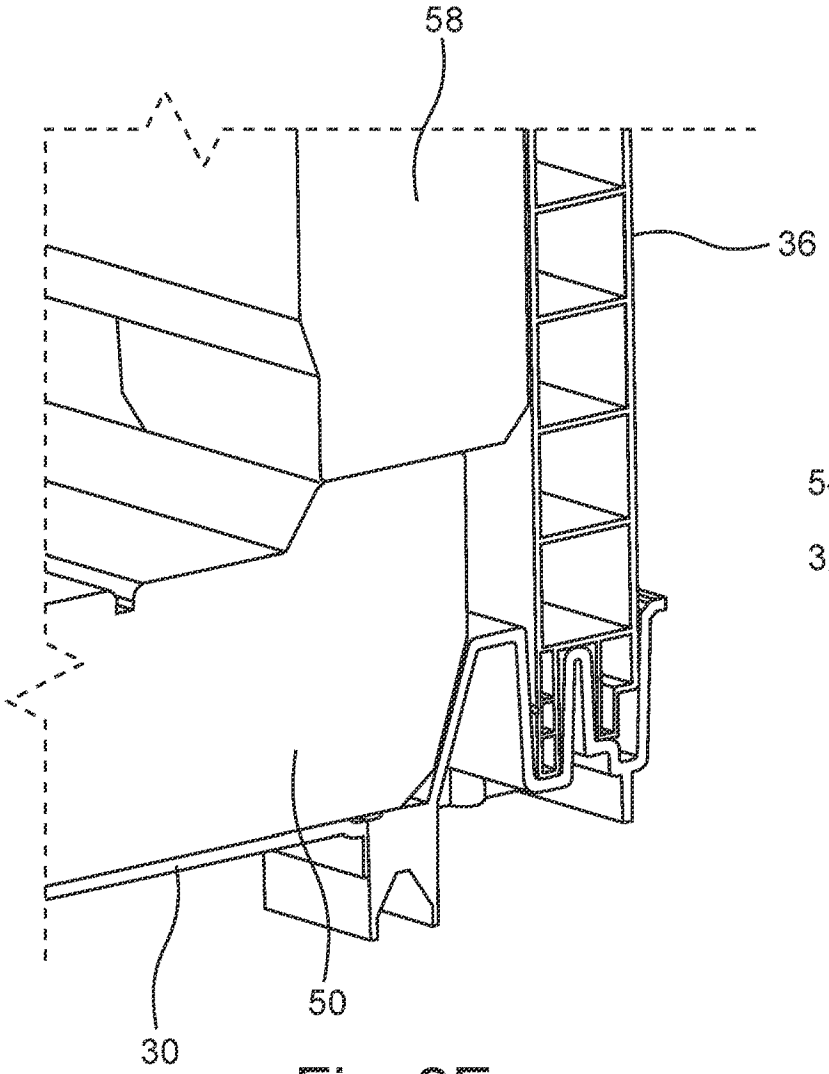
FIG. 2E is an enlargement of the portion marked 2E in FIG. 2A.

With reference to the annexed drawings, there is illustrated in FIGS. 1A and 1B a cooler container assembly generally designated 20 comprising a housing container generally designated 22 and a storage container generally designated 24, fitted within the housing container 22 at a fit/snug configuration.

With Further reference to FIGS. 2A to 2E and 3, the housing container 22 is a box-like structure (bin), comprising a base 30 from which upwardly extend, two side walls 32, a front wall 34 and a back wall 36. The housing container 22 is made of rigid material such as Polypropylene, and in the illustrated example at least side walls 32, front wall 34 and back wall 36 are made of two layered Polypropylene boards, having improved thermal insulation and rigidity. The housing container 22 can be a solid unitary molded item, or it can be configured for assembly/knockdown. The housing container can be made of other material, such as wood, metal or even be a built-in niche made of any material, including concrete, however with access to an opening of the storage container received therein.

A lid 38 is pivotally secured to the back wall 35 by a hinge system 29 (FIG. 2A), with a stay-open support piston mechanism 40 (FIG. 1B), and a smart lock generally designated 42 is configured at a top front portion of the housing container 22, with a reinforcing steel bar 46 (FIG. 2B) extending at least at a top portion of the front wall 34, and optionally at a front portion of the lid 38, for improving rigidity and tamper-proofing the locking mechanism 42. The smart lock mechanism can be configured with biometric and/or digital features, whereby the lid 38 can be opened only by authorized individuals, under predetermined categories. Likewise, the smart lock mechanism 42 can be configured for remote communication and activation thereof.

With further attention FIGS. 4A to 4E particular reference is made to the storage container 24 a base wall member 50 and an upwardly extending right side wall 52, a left side wall 54, a front wall 56, and a back wall 58. The walls are made of light weight, high thermal insulating material, such as boards of EPP.

The storage container 24 is a knock-down structure, wherein it is easily and readily erected or disassembled. However, it is appreciated that the b is a foolproof configuration, wherein it can be assembled only at a particular configuration, in conformity with compartments therein, as will become apparent hereinafter. For making sure that the storage container 24 is properly assembled/erected, the base 50 is configured with several upward extending projections 64 and depressions 66. Respectively, the right side wall 52, left side wall 54, front wall 56 and the back wall 58 are configured, in register with the projections 64 and depressions 66, with downward facing projections 68 and depressions 70, whereby the walls (right side wall 52, left side wall 54, front wall 56 and the back wall 58) can be assembled to the base only at a predesign arrangement, namely the walls cannot be mistakeably replaced with one another. For that purpose, visible indicia can be provided too (apart for the must-match geometry, which by itself is visible too).

Articulating the walls (right side wall 52, left side wall 54, front wall 56 and the back wall 58) over the base 50 gives rise to a basin defining a thermally insulated interior space 69.

The storage container 24 is configured with several partition walls, also made of a thermally insulating material, dividing the space 69 into several compartments/chambers, namely a cooling chamber 76, a freezer compartment 78, a chilled compartment 80 and an ambient compartment 82.

The cooling chamber 76 is defined between a freezer partition wall 86 (extending between the cooling chamber 76 and the freezer compartment 78) and a chill partition wall 88 (extending between the cooling chamber 76 and the chilled compartment 80), and wherein the chilled compartment 80 is partitioned from the ambient compartment 82 by an ambient partition wall 92. The arrangement is such that the compartments 78, 80 and 82 are disposed at fixed locations with respect to one another, with the cooling chamber 76 disposed between the freezer compartment 78 and the chilled compartment 80. However, if desired, the ambient partition wall 92 can be removed, thereby increasing the space of the chilled compartment.

The chambers/compartments too are configured for foolproof assembly, so as to make sure that the partition walls are properly assembled, in compliance with thermal and airflow considerations, as will be explained herein after in detail. For that purpose, an arrangement is provided such that the walls of the container 20, and the partition walls within the container, can be assembled at a predefined position only.

Figure 4A:
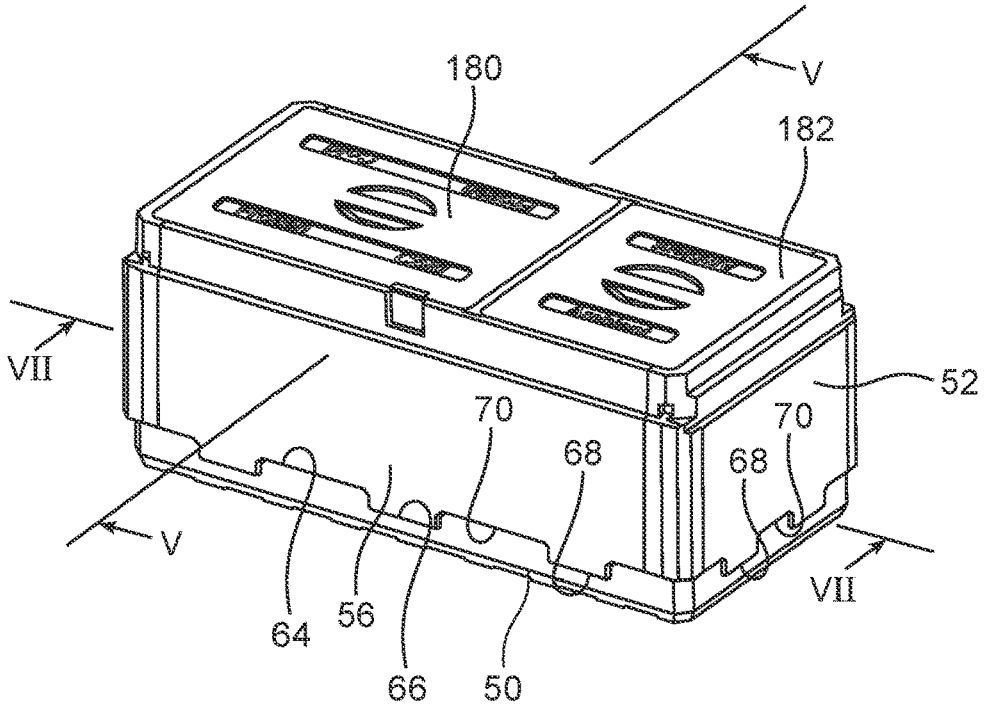
FIG. 4A is a perspective view of a storage container according to the disclosure, apart from the housing container.
Figure 4B:
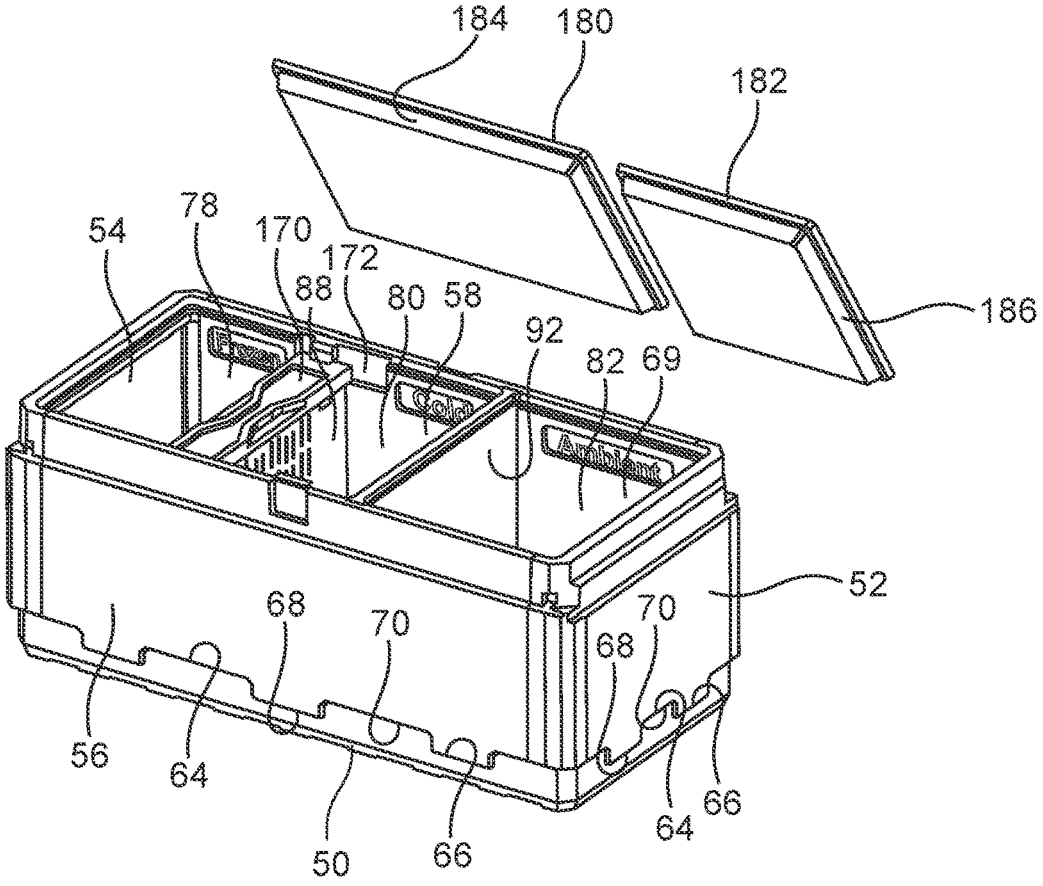
FIG. 4B is the same as FIG. 4A, with the removable covers displaced for exposing an insulated interior space of the storage container.
Figure 4C:
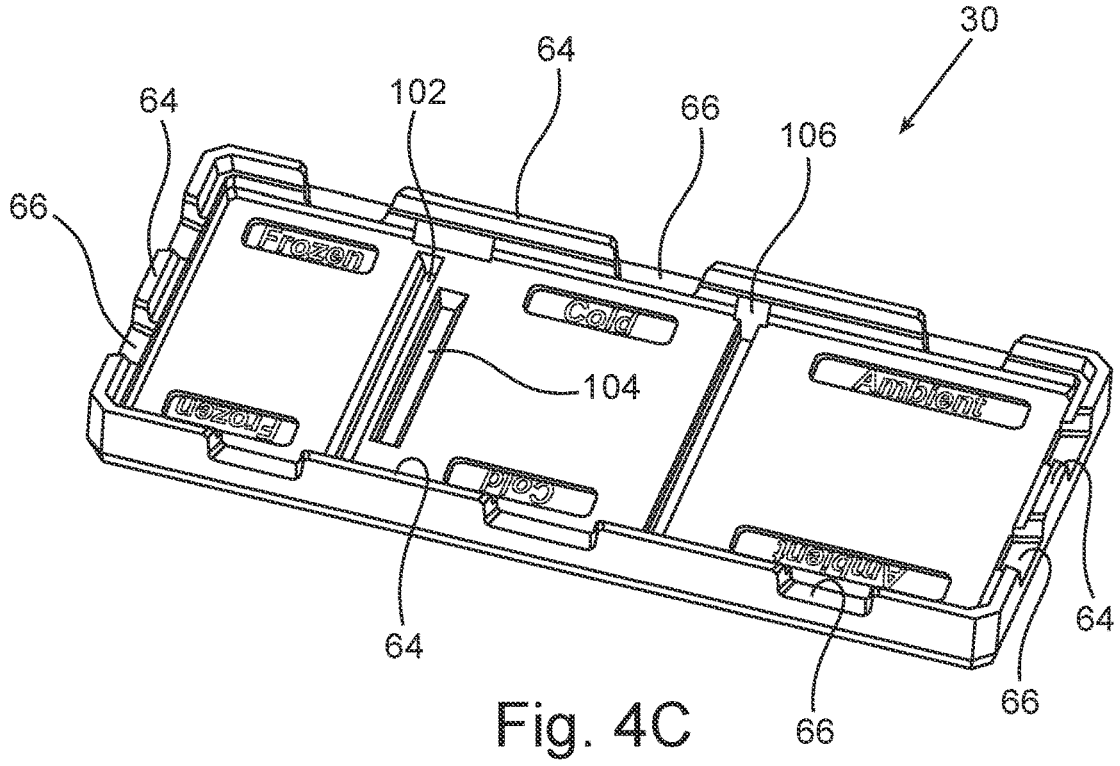
FIG. 4C is a perspective view of a base member of the storage container.
Figure 4D:
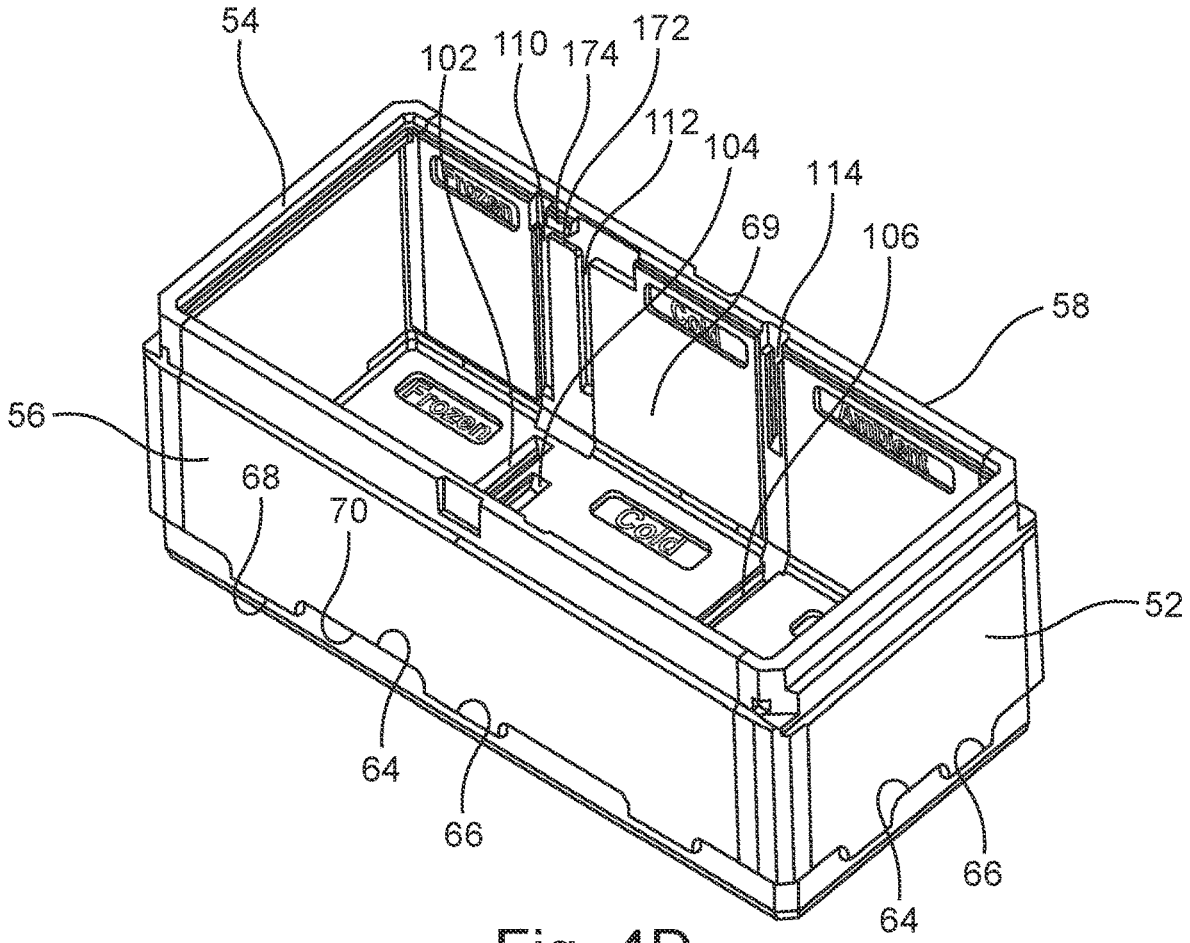
FIG. 4D is a top perspective view of the storage container, however with all partition walls removed.
Figure 5:
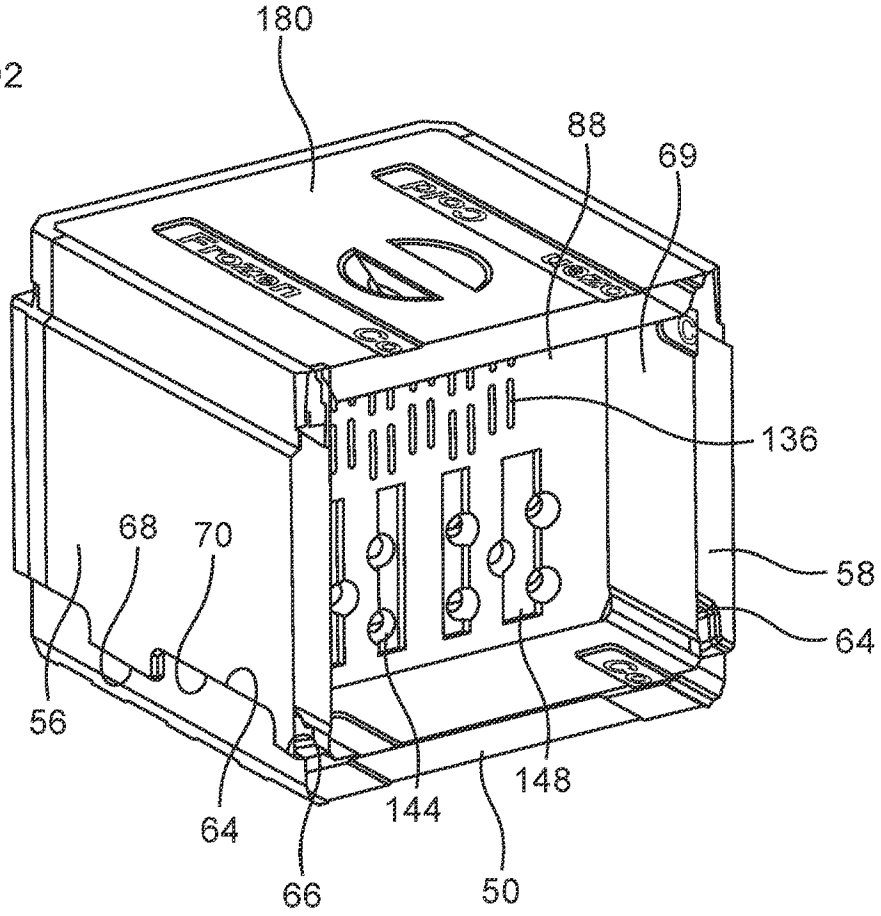
FIG. 5 is a vertical section taken along line V-V in FIG. 4A.
Figure 4E:
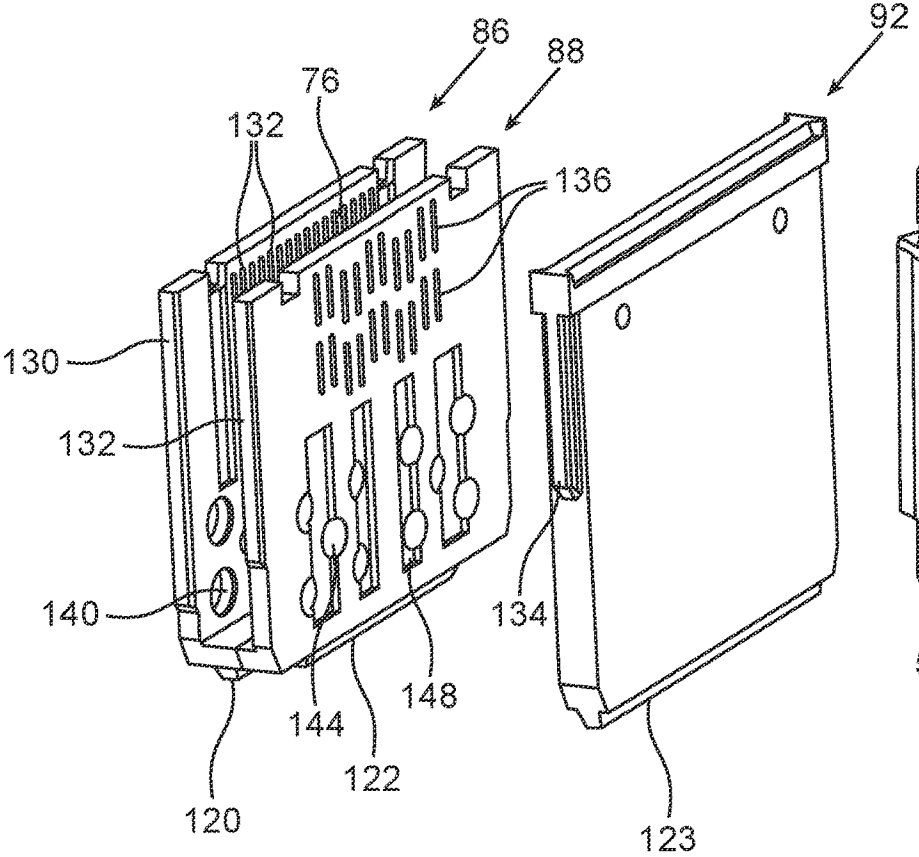
FIG. 4E is a top perspective view of the partition walls of the storage container, isolated.
Figure 6A:
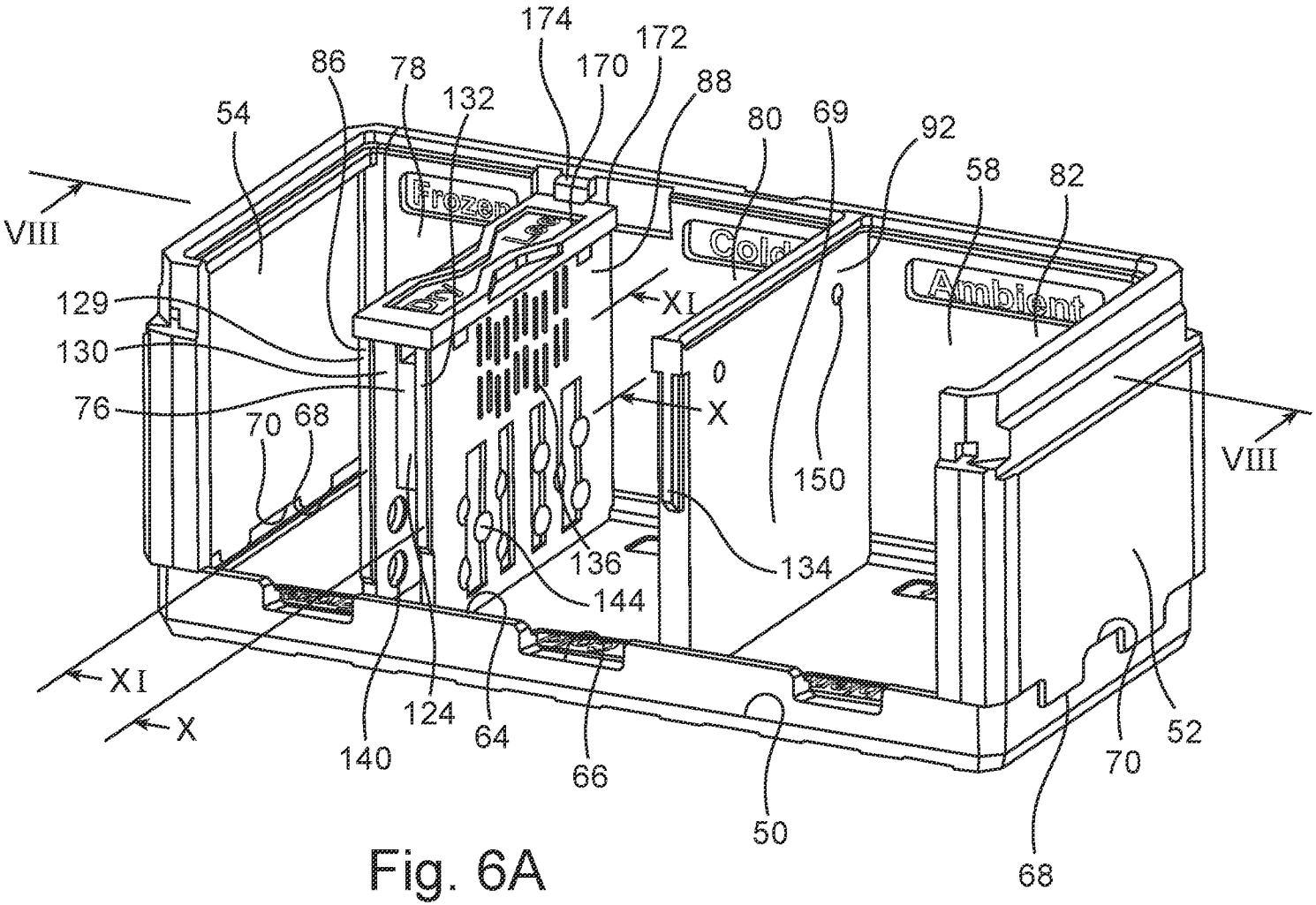
FIG. 6A is a top right perspective view of the storage container, with a front wall thereof removed.
Figure 6B:
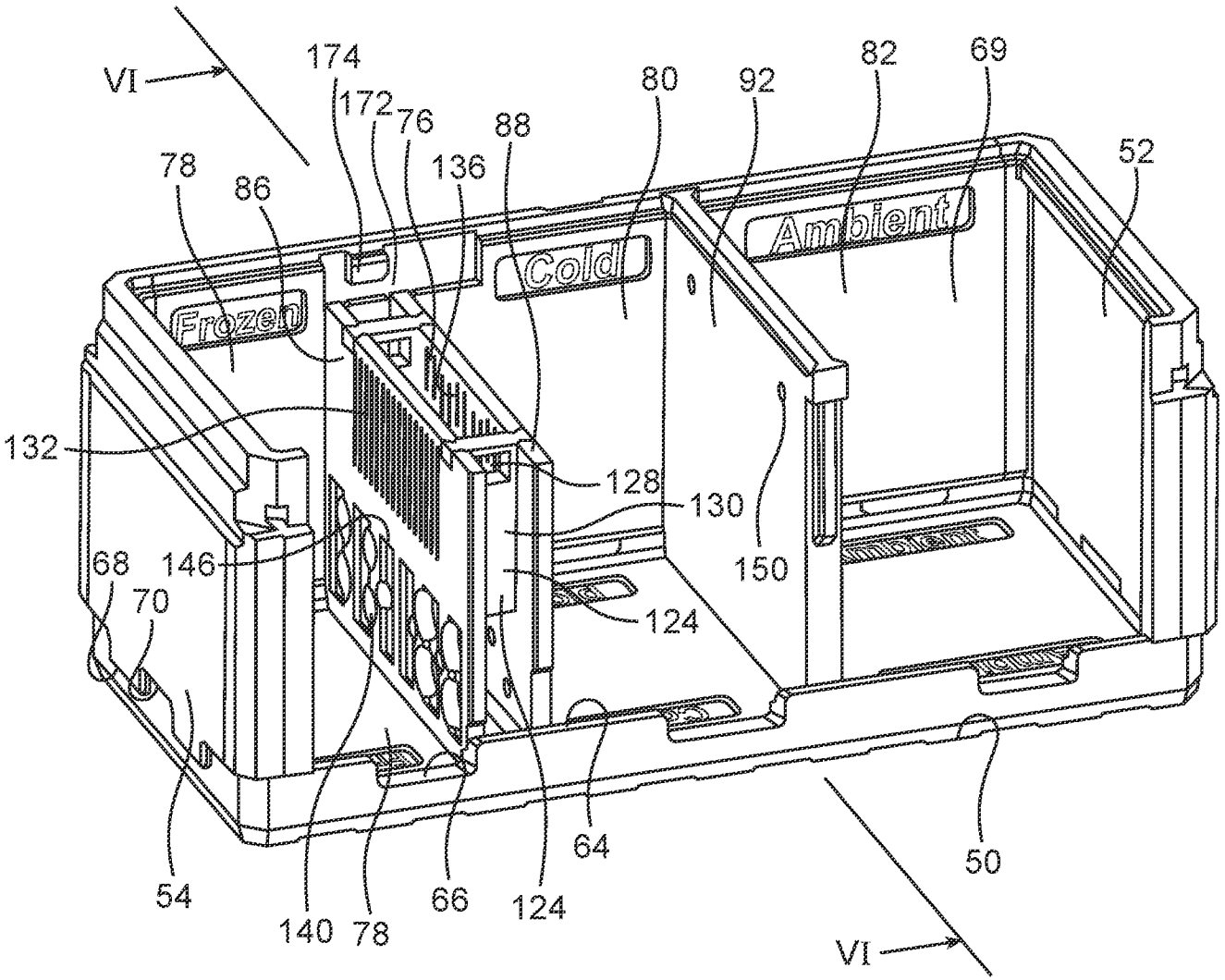
FIG. 6B is a top left perspective view of the storage container, with a front wall thereof removed.
Figure 6C:
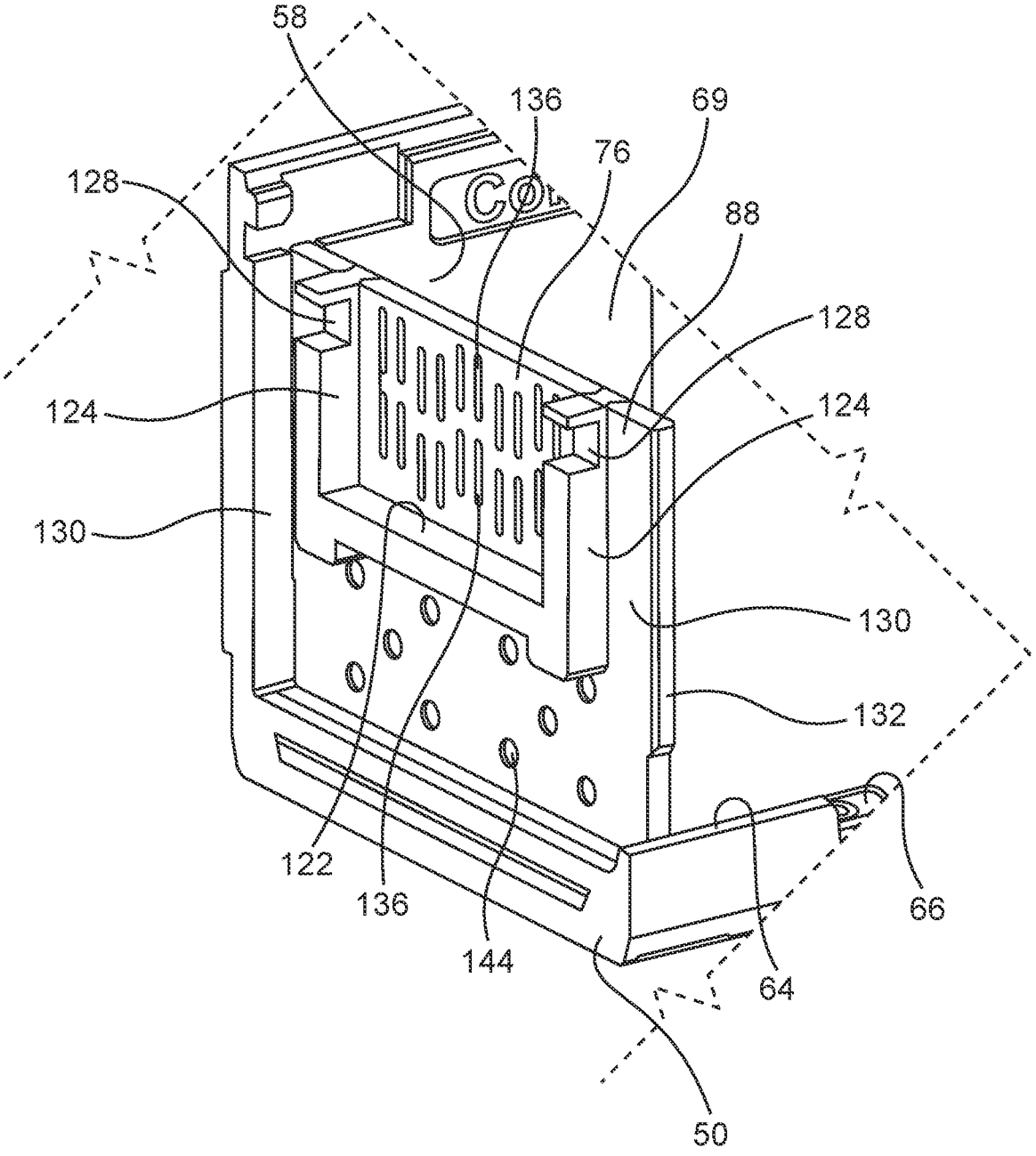
FIG. 6C is a vertical section along line VI-VI in FIG. 6B.
Figure 7:
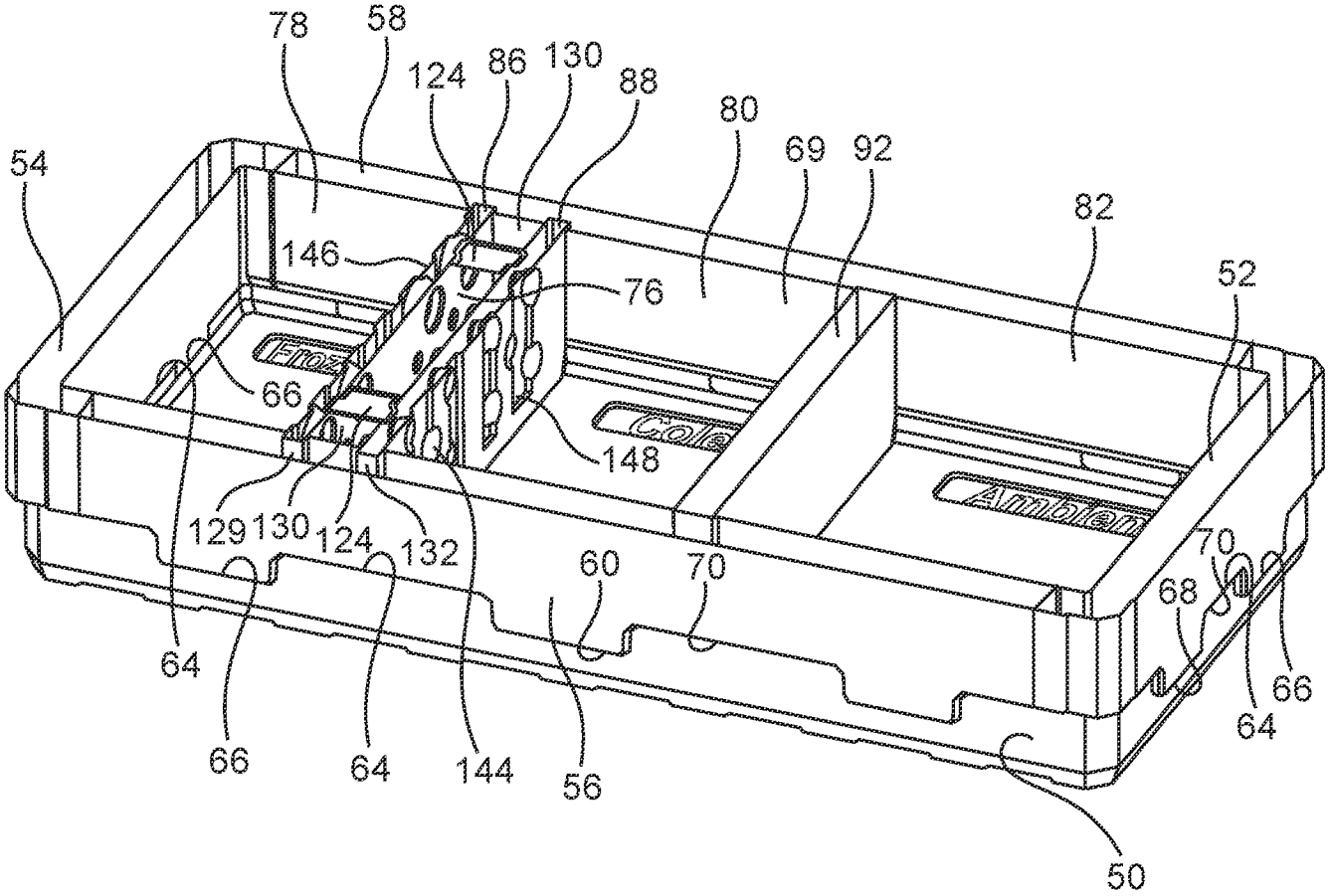
FIG. 7 is a planar section along line VII-VII in FIG. 4A.

As can be seen, best in FIGS. 4C and 4D, the base member 30 is configured with three longitudinal recesses 102, 104 and 106, extending between a back side and a front side of the base member, wherein each of said recesses 102, 104 and 106 has a unique cross section and spans along a different length. Furthermore, the front wall and the back wall 58 are configured with upright extending slots 110, 112 and 114, in alignment with the recesses 102, 104 and 106, wherein each of the slots 110, 112 and 114 has a unique cross section and length.

In order to assure that each of the freezer partition wall 86, chill partition wall 88 and ambient partition wall 92 is unequivocally assembled at the right location within the basin of the container 20, at a correct orientation, each of said partition walls 86, 88 and 92 is configured at its bottom edge with a projecting ridge (120, 122 and 123, respectively), wherein each of these ridges corresponds with one of the respective recesses 102, 104 and 106 as far as cross section and length. Furthermore, each of the partition walls 86, 88 and 92 is configured at its respective side edges with a laterally projecting rib 129, 132 and 134 (FIG. 4E), wherein each of these ribs corresponds with one of the slots 110, 112 and 114, respectively, as far as cross section and length.

The combination of the unique configurations of recesses and ridges, and recesses and ribs, respectively, makes sure that the partition walls 86, 88 and 92 can be assembled at the correct location and at the correct orientation, which true positioning has significant meaning as far as air flow and air circulation within the space 70 (i.e. between the compartments 78, 80 and 82) as will be explained herein below.

The cooling chamber 76 is a space extending between the freezer partition wall 86 and the chill partition wall 88, said walls being spaced apart at a set distance (by their fixed positioning to the front and back wall and the base, as mentioned hereinabove), with a cooling medium support 121 disposed about mid-height of the cooling chamber 76, with two side walls 124 giving rise tighter to a cooling medium receiving space configured for receiving a commercially available dry ice pack, or any other cooling medium such as ice and the like. It is noted that each of the two side walls 124 is configured at a top portion thereof with an opening 128, to be discussed hereinafter, and further wherein said side walls 124 extend inwards from side edges of the partition walls 86 and 88, giving rise to lateral flow paths 130, also to be discussed hereinafter.

Furthermore, the freezer partition wall 86 is configured at a top portion thereof, with a plurality of refrigerator apertures in the form of thronging longitudinal slots 132. It is apparent the refrigerator apertures 132 extend above the cooling medium support 121 and between the side walls 124. The refrigerator apertures 132 are of uniform cross section and are child-safe, i.e. being sufficiently small to prevent a child for sticking his fingers therethrough. Similarly, the chill partition wall 88 is configured at a top portion thereof, with a plurality of refrigerator apertures, in the form of thronging longitudinal slots 136, however disposed in two rows, above one another, and extending at different heights. The refrigerator apertures 136 too, extend above the cooling medium support 121 and between the side walls 124, and are of uniform cross section and are child-safe, i.e. being sufficiently small to prevent a child for sticking his fingers therethrough. It is appreciated that the total section area of refrigerator apertures 136 is smaller than the total section area of refrigerator apertures 132.

The freezer partition wall 86 is configured at a bottom portion thereof (below the cooling medium support 121), with a plurality of air circulation apertures 140, wherein said apertures are frustoconical, having a wider base at a face of the freezer partition wall 86 facing the freezer compartment 78, and a narrower base at a face of the freezer partition wall 86 facing the cooling chamber 76.

The chill partition wall 88 is configured at a bottom portion thereof (cooling medium support 121), with a plurality of air circulation apertures 144, wherein said apertures are frustoconical, and disposed at an opposite orientation of apertures 140 i.e., having a wider base at a face of the chill partition wall 88 facing the chilled compartment 80, and a narrower base at a face of the chill partition wall 88 facing the cooling chamber 76. Furthermore, the apertures 144 are smaller and fewer than apertures 140, wherein a total section area of the apertures 144 is smaller than section area of the apertures 140, to be discussed herein below.

It is further noted that the apertures 140 and 144 extend over longitudinal depressions 146 and 148, respectively. The arrangement is such that even at the event that an item (i.e. groceries) bear against the wall surface, the respective apertures remain open for air flow therethrough.

Figure 8A:
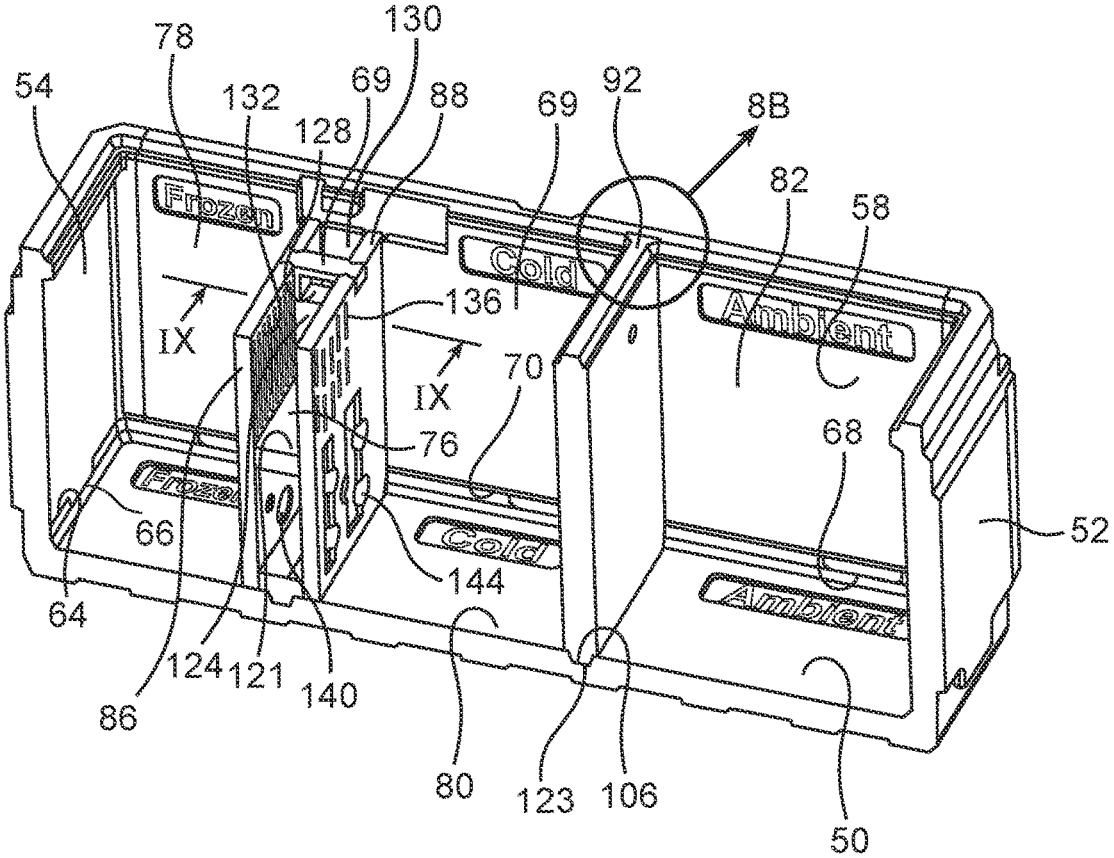
FIG. 8A is a vertical section along line VIII-VIII in FIG. 6A, with a top cover of the cooling chamber removed.
Figure 8B:
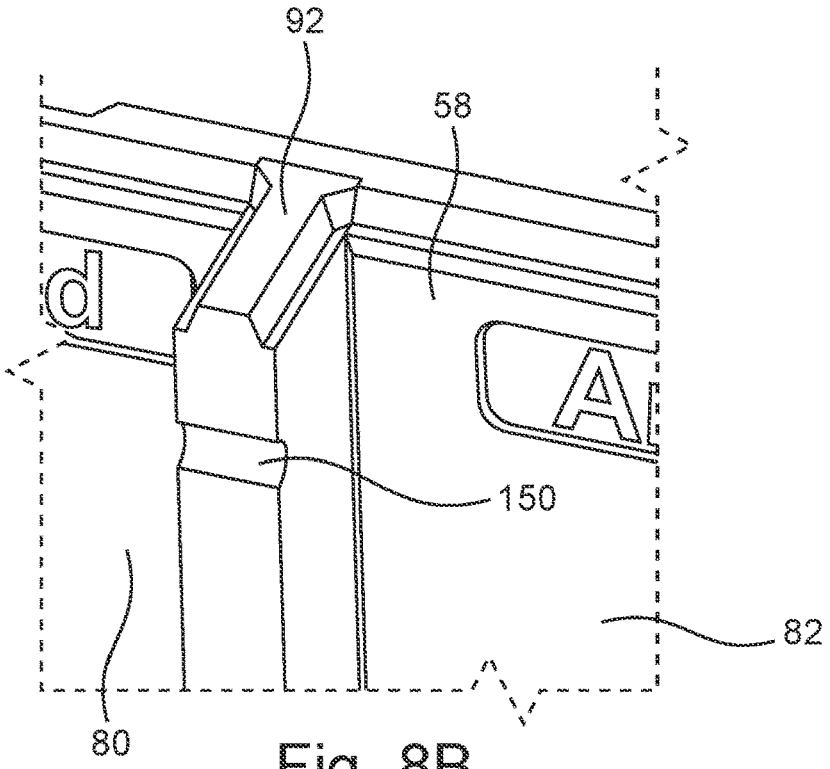
FIG. 8B is an enlargement of the portion marked 8B in FIG. 8A.
Figure 8D:
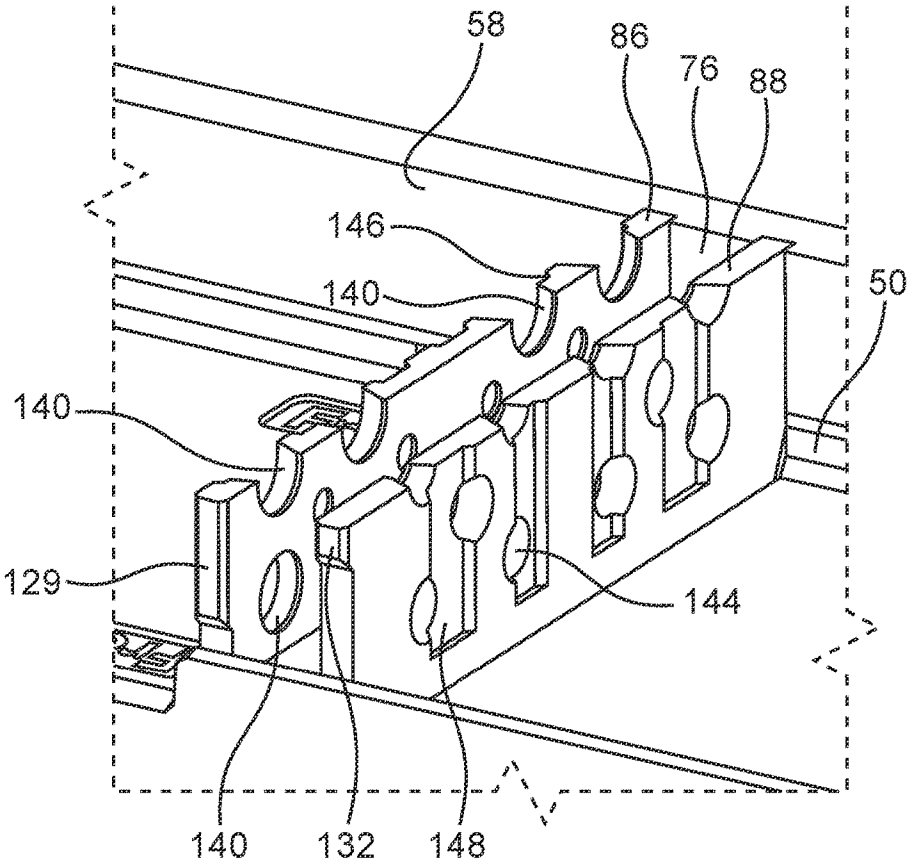
FIG. 8D is a local planar section along line X-X in FIG. 6A.
Figure 8C:
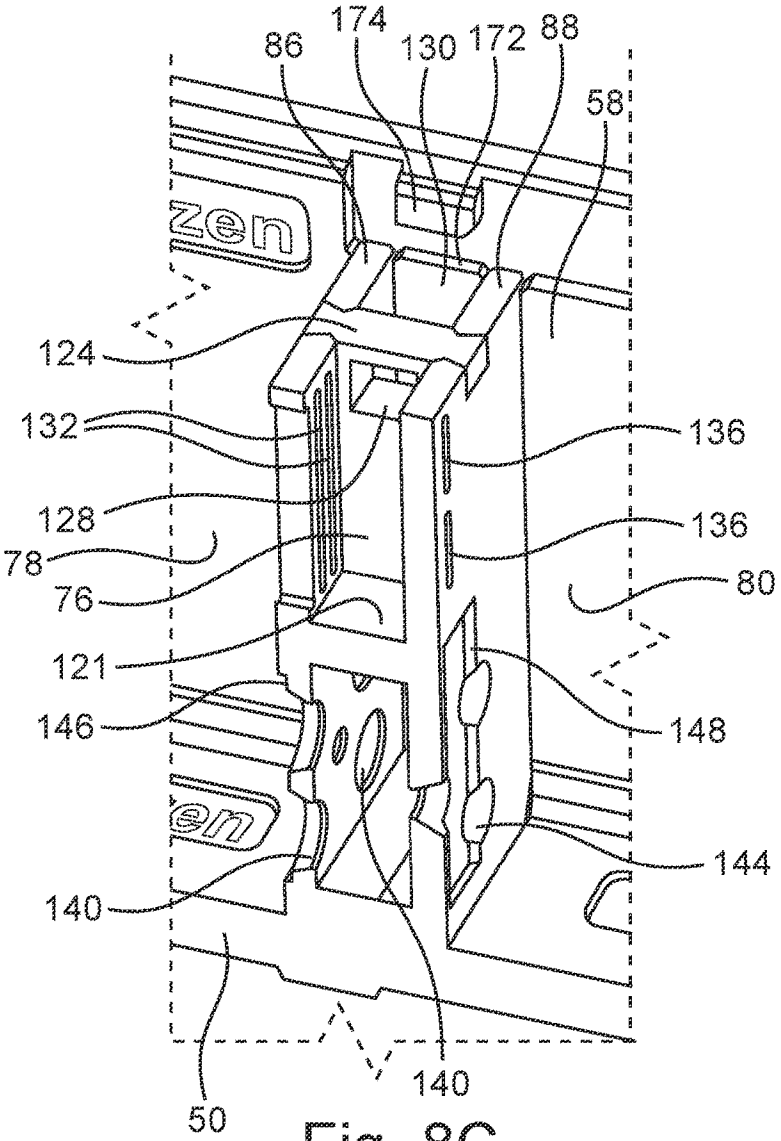
FIG. 8C is a local planar section along line IX-IX in FIG. 8A.
Figure 8E:
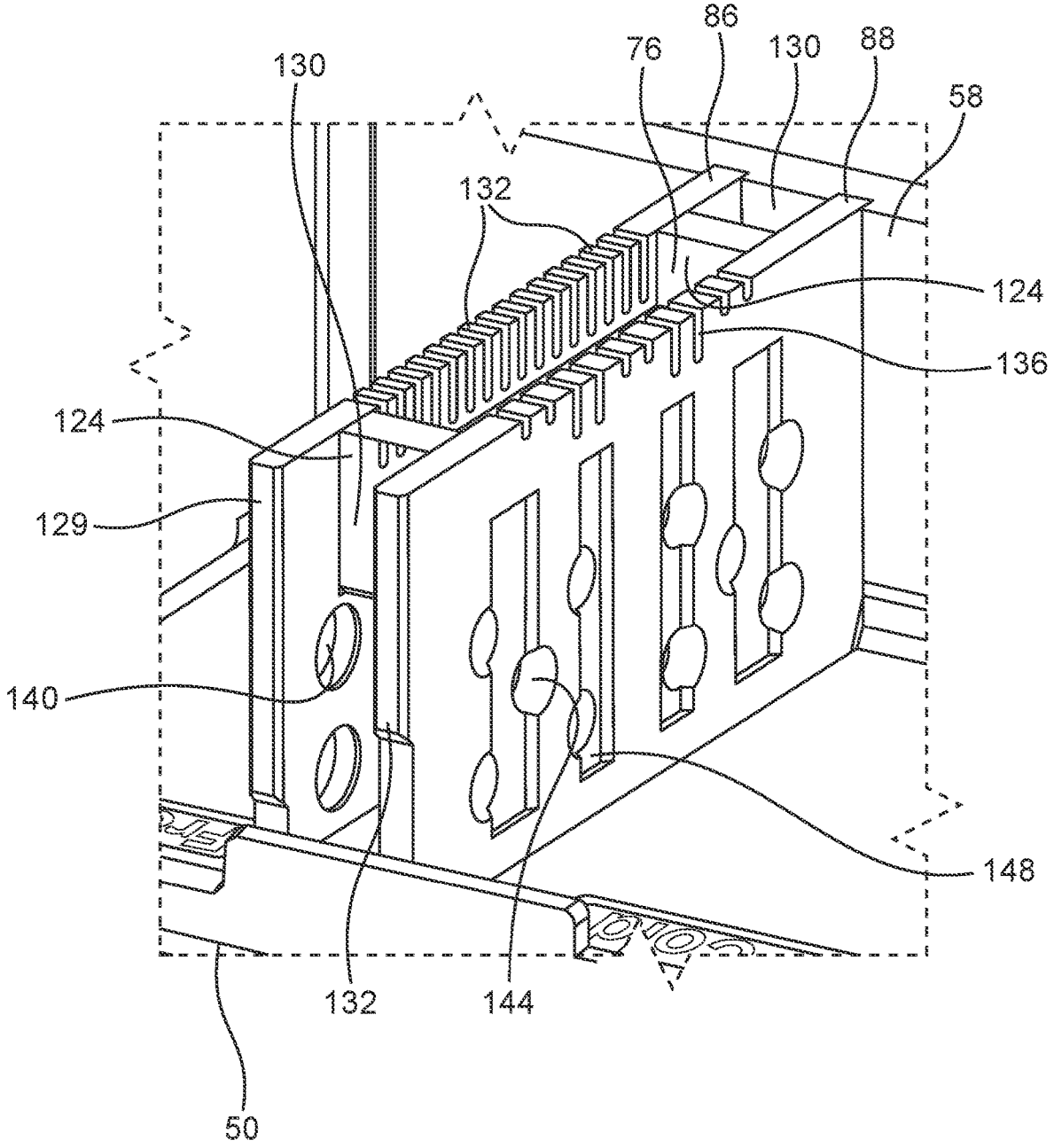
FIG. 8E is a local planar section along line XI-XI in FIG. 6A.

Turning now to ambient partition wall 92, it is configured at a top portion thereof with two thoroughgoing cylindrical apertures 150 (FIG. 8B), said apertures 150 configured for air flow/circulation between the chilled compartment 80 and the ambient compartment 82, to allow some chilled air to flow into the ambient compartment 82 and keep it from heating.

As noted, for example in FIGS. 4B, 4D, 6B and 8C, the cooling chamber 76 comprises a top cover 170 for covering the cooling chamber space, wherein the top cover 170 is configured with a child-proof arrangement, so as to prevent or reduce the likelihood of a child displacing the top cover between an open position at which the top cover can be opened to facilitate access into cooling chamber space, and a closed position. The child-proof arrangement is a sliding path 172 configured at an inside face of the front wall and the back wall of the storage container, with an arresting block 174 disposed there above.

At the closed position, the top cover 170 rests over a top edge of the freezer partition wall 86 and the chill partition wall 88. The arrangement is such that removing of the top cover 170 can be facilitated upon first sliding it towards the chilled compartment 80 (rightwards), so as to disengage from arresting block 174, and only thereafter can the top cover 170 be removed upwards.

Two removable covers 180 and 182 are provided, also made of high thermal insulating material, such as boards of EPP. The covers are each configured with a downward facing chamfered rim 184 and 186 respectively, wherein cover 180 is configured for bearing over top edges of the back wall 58, left side wall 54 and front wall 56, covering the freezer compartment 78, cooling chamber 76 (with the top cover 170 in place) and the chilled compartment 80, wherein the chamfered rim 184 bears against corresponding chamfered seats at the top portion of the respective walls. The cover 182 is configured for bearing over top edges of the back wall 58, right side wall 52 and front wall 56, covering only the ambient compartment 82, wherein the chamfered rim 186 bears against corresponding chamfered seats at the top portion of the respective walls.

Turning now to FIGS. 9.1 to 9.14 there is illustrated an assembly sequence of a cooler container assembly 20. First, the 38 of housing container 22 is opened (kept at this position by the stay-open support piston mechanism 40) and a base member/wall 50 of storage container 24 is placed into the housing container 22 and placed over the base 30 (FIG. 9.1). It is appreciated that placing the base member 50 in fact determines positioning of all other elements of the storage container 24, owing to the must-match design as discussed herein above.

Then, left side wall 54 is placed flush against the left side wall 32 of the housing container 22 and articulated to the base 50 such that projections 68 and depressions 70 at the bottom edge of the left side wall 54 engage the projections 64 and depressions 66, at the foolproof manner (FIG. 9.2). Similarly, are assembled the right side wall 52 (FIG. 9.3), the back wall 58 (FIG. 9.4) and the front wall 56 (FIG. 9.5), giving rise to the thermally insulated interior space 69.

Then, ambient partition wall 92 is slidably introduced into the space 69, all the way done, with laterally projecting ribs 132 snugly received within vertical slots 114 at the front wall 56 and the back wall 58, until and the downward projecting ridge 123 is well received within corresponding respective recess 106 at the base 50 (FIG. 9.6), thereby giving rise to the ambient compartment 82.

Similarly, freezer partition wall 86 is placed into the uniquely dedicated slot system within space 69, giving rise to the ambient compartment 78 (FIG. 9.7), and the chill partition wall 88 is placed into its respective uniquely dedicated location, giving rise to the chilled compartment 80 and to the cooling chamber 76 (FIG. 9.8). It is appreciated, as mentioned herein before, that the partition walls 92, 86 and 88 can be positioned only at their respective allocated location and only at the correct position thereof.

Then, the two side walls 124 of the cooling chamber 76 and the cooling medium support 121 are attached to one another to form a sub-assembly 125 (FIG. 9.9) which sub-assembly 125 is then fixed within the cooling chamber 76 (FIG. 9.10). Top cover 170 of the cooling chamber 76 can then be introduced into the sliding path 172 (FIG. 9.11) and is then slidingly displaced along sliding path 172 into its locked position under arresting block 174 (FIG. 9.12). Finally, the two removable covers 180 and 182 are positioned over the respective chambers (FIG. 9.13), obtaining the assembled cooler container assembly 20, ready for use.

It is appreciated that the cooler container assembly 20, and in particular storage container 24, is knocked down, i.e. disassembled at a reverse sequence of operations.

It is seen in the drawings that the walls and removable covers are configured with visible indicia, which in the present example reads 'Frozen', 'Cold' and 'Ambient', said indicia aiding in assembly as well as in use of the cooler container assembly 20.

Figure 10A:
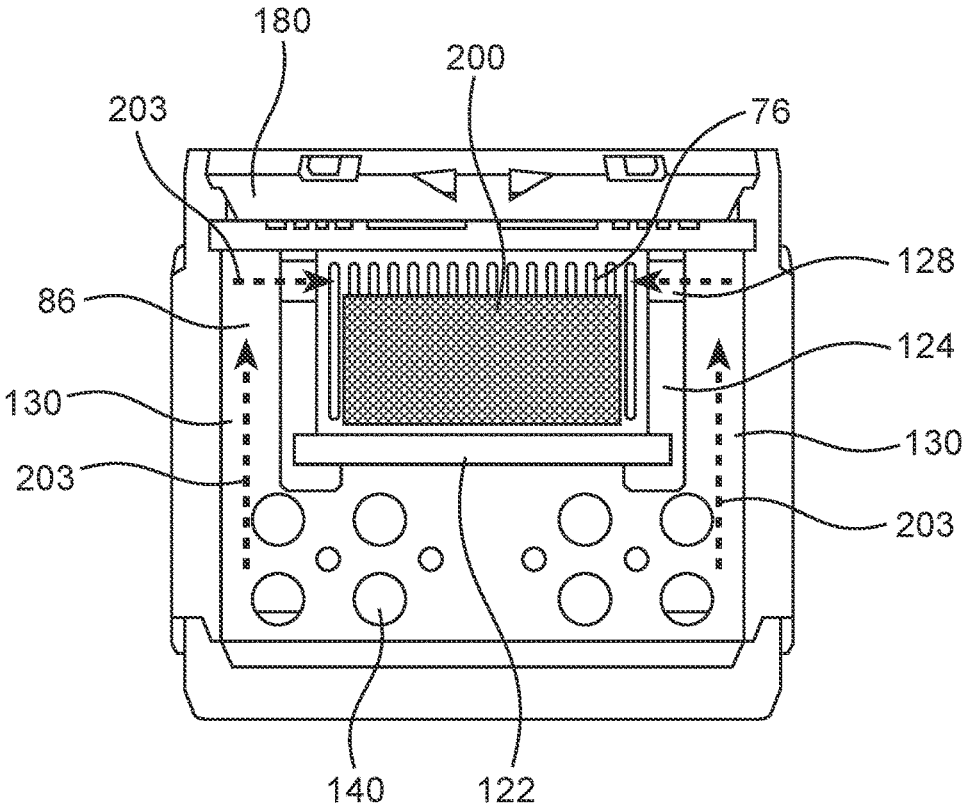
FIGS. 10A and 10B are sections through the cooler container assembly, schematic illustrating warm/cool air flow paths within the interior space of the storage container.
Figure 10B:
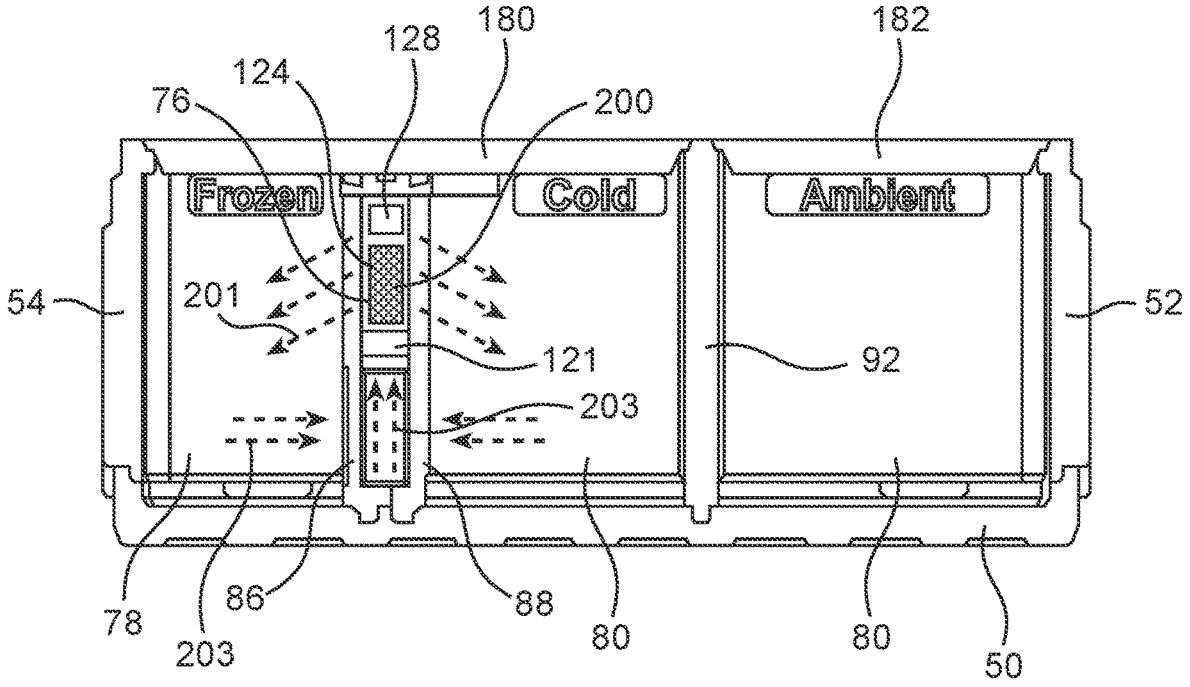

Turning now to FIGS. 10A and 10B, an air flow scheme is presented, showing a cooling medium 200 (e.g. a dry ice pack) received within the cooling chamber 76 and placed over the cooling medium support 121 between the two side walls 124, wherein cold air flow emitted from the cooling medium 200 is represented by sold arrows 201, and circulated (warmer) air is represented by dashed arrows 203. It is noted that cooled air emitted from the cooling medium 200 flows from the cooling chamber 76 through apertures 132 into freezer compartment 78 and through apertures 136 into chilled compartment 80, wherein the warmer air circulated from the chambers 78 and 80 into the space below cooling medium support 121, then up along lateral flow paths 130 into the cooling chamber, where the air is chilled again by the cooling medium 200, and so on.

Figure 11:
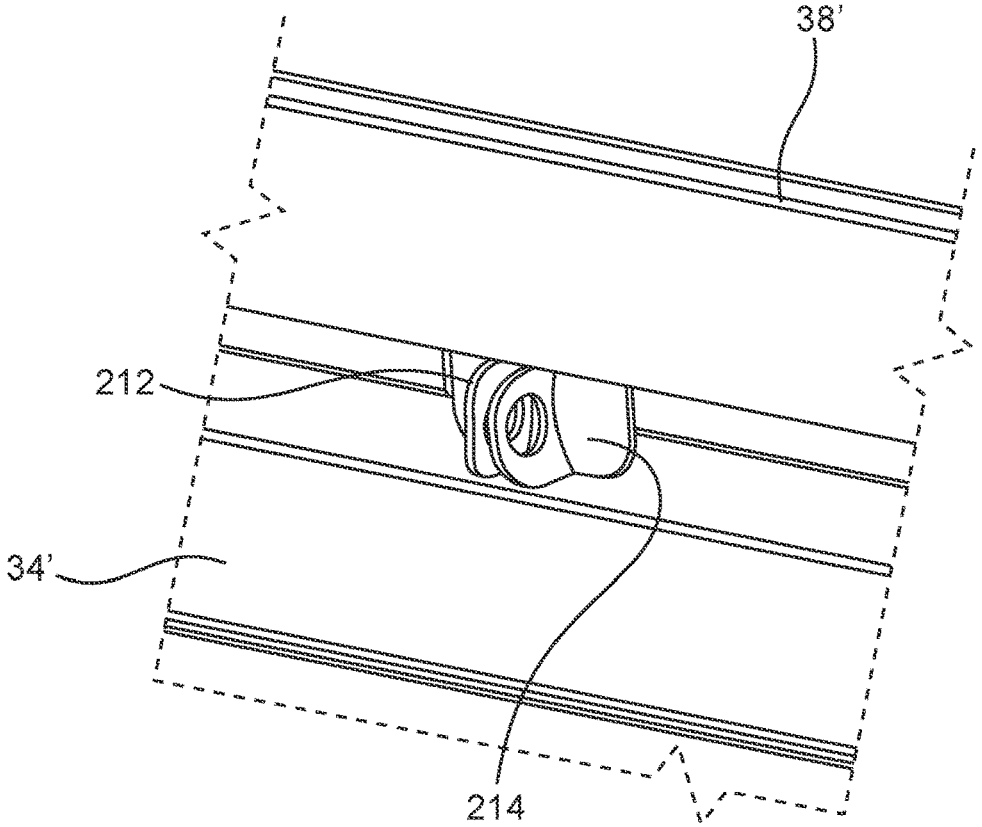
FIG. 11 is an enlarged view of ab alternative locking arrangement of the storage container.
Figure 12A:
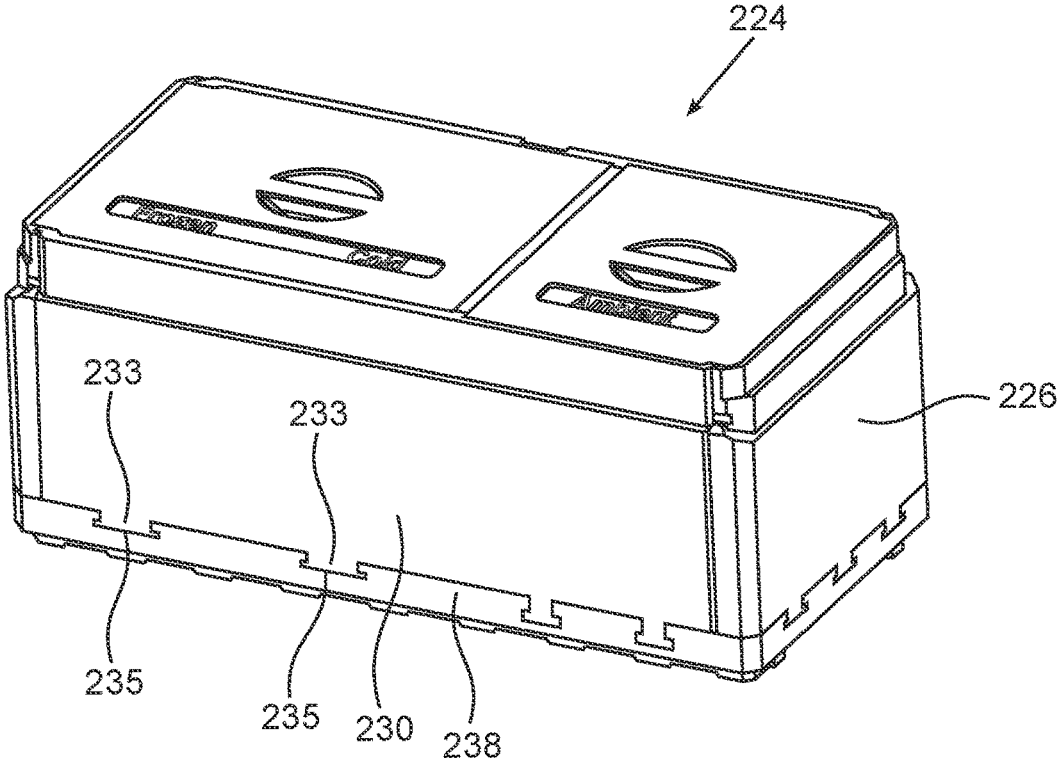
FIG. 12A is a perspective view of a storage container according to another example of the disclosure.
Figure 12B:
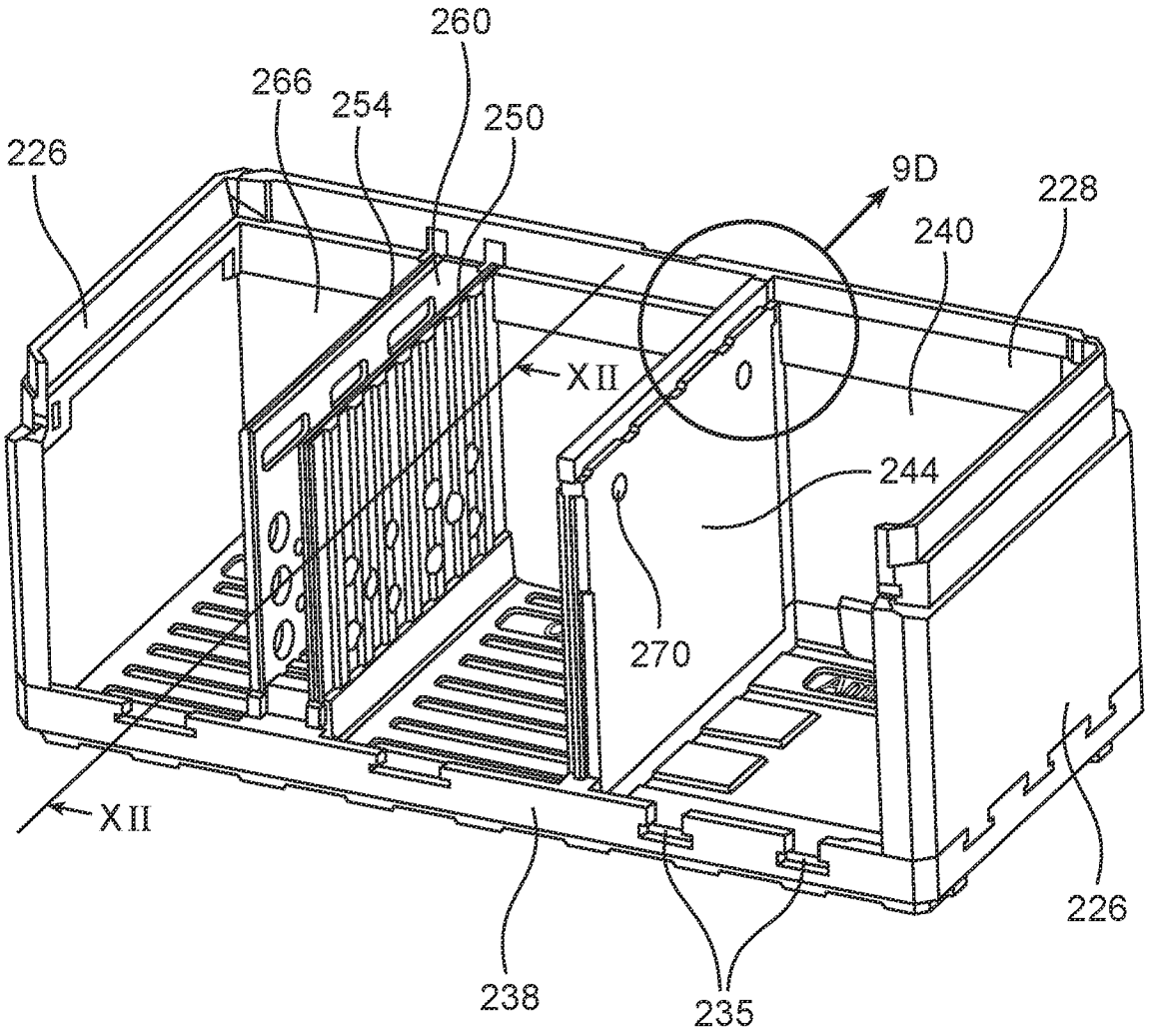
FIG. 12B is a top right perspective view of the storage container of FIG. 12A, with a front wall removed.
Figure 12C:
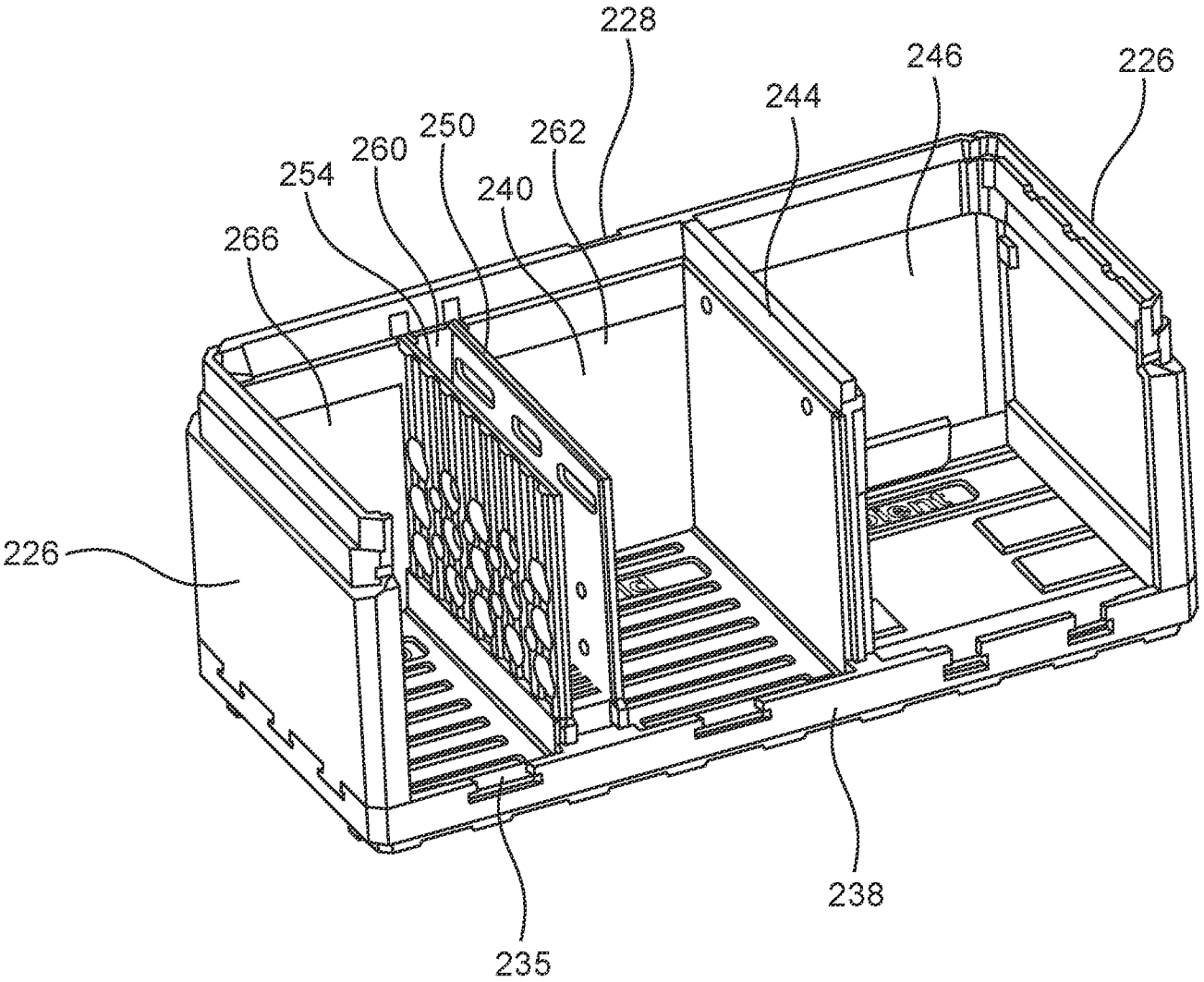
FIG. 12C is a top left perspective view of the storage container of FIG. 12A, with a front wall removed.
Figure 12D:
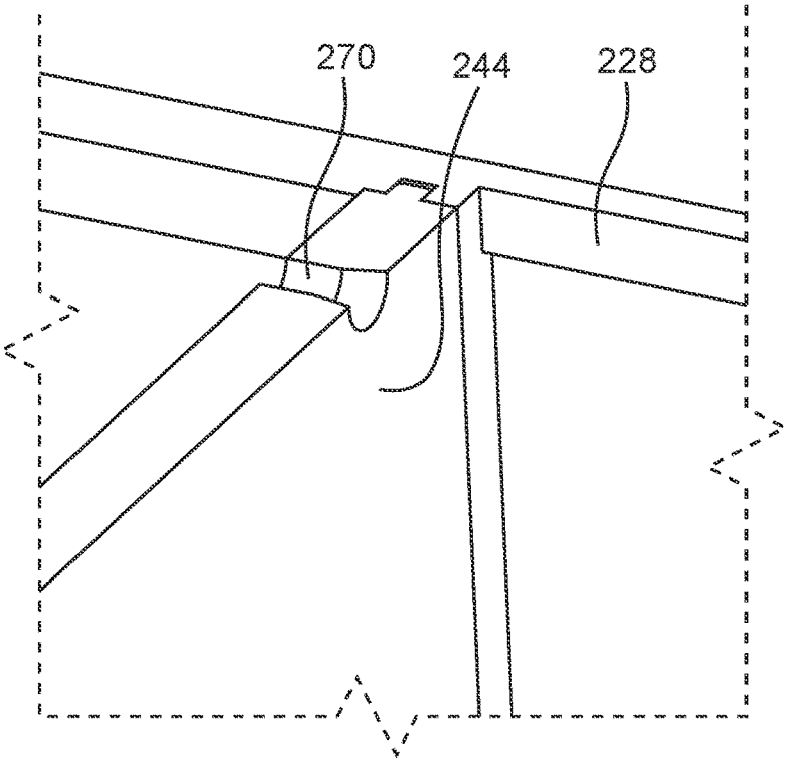
FIG. 12D is an enlarged view of the portion marked 12D in FIG. 12B.
Figure 12E:
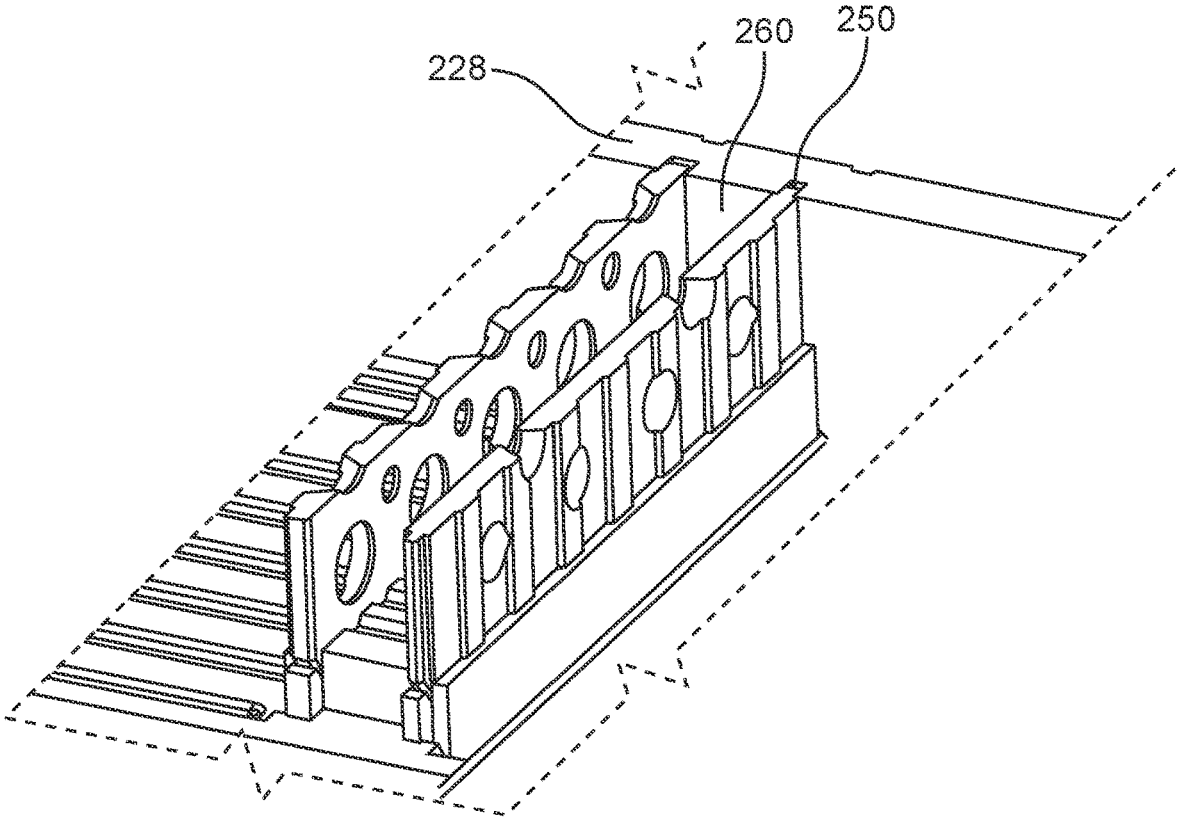
FIG. 12E is a local planar section along line XII-XII in FIG. 12B.

FIG. 11 is an example of a cooler container assembly 20 according to the disclosure, wherein rather than a smart lock there is configured a simple locking arrangement wherein each of the front wall 34' and the lid 38' is configured with a locking eye 212 and 214, respectively, lockable by a pad lock (not shown).

FIGS. 12A to 12E illustrate another example of storage container according to the present disclosure. In the illustrated example storage container 224 comprises walls (side walls 226, back wall 228 and front wall 230) configured at their bottom edge with a (male) dovetail configuration 233 for articulation with a respectively mating (female) dove tail arrangement 235 configured at the base member 238, wherein it is seen that according to this example too there is a foolproof arrangement, whereby the dovetail coupling arrangements differ in size and (optionally in shape too) such that the walls can be secured to the base only at a predefined position.

The basin space 240 of the storage container 224 is configured with an ambient partition wall 244 giving rise to an ambient compartment 246, a chill partition wall 250 and a freezer partition wall 254 defining between them a cooling chamber 260, and chilled chamber 162 between the chill partition wall 250 and the ambient partition wall 244, and a freezer compartment 266 between side wall 226 and freezer partition wall 254.

The ambient partition wall 244 is configured at a top portion thereof with several throughgoing air circulation apertures 270, which unlike the previous example have a tapering cross section, with a wider section at the ambient chamber facing side, thereby encouraging cool air flow from the cooling chamber 260 into the ambient compartment 246.

Yet a difference resides in the cooling chamber 260 lacking a cooling medium support, such that the entire cooling chamber 260 can accommodate a cooling medium.

The invention claimed is:

1. A storage container having a basin defining an interior space, and comprising two or more partition walls; a freezer partition wall defining a freezer compartment, a chill partition wall defining a chilled compartment, a cooling chamber being defined between said partition walls, wherein each of said partition walls are configured, when a cooling medium is received within said cooling chamber, for allowing airflow therethrough to its respective compartment, thereby maintaining a temperature difference between said freezer compartment and chilled compartment, said cooling chamber is disposed intermediate said freezer compartment and said chilled compartment, and the freezer partition wall faces the freezer compartment and the chill partition wall faces the chilled compartment, said the freezer partition wall is configured at a bottom portion thereof with a plurality of first frustoconical apertures, having a wider base at a face of the freezer partition wall that faces the freezer compartment and a narrower base at a face of the freezer partition wall that faces the cooling chamber, said the chill partition wall is configured at a bottom portion thereof with a plurality of second frustoconical apertures, having a wider base at a face of the chill partition wall that faces the chilled compartment and a narrower base at a face of the chill partition wall that faces the cooling chamber, and a total section area of the second frustoconical apertures being smaller than a total section area of the first frustoconical apertures, wherein when a cooling medium is received within said cooling chamber, directional airflow through the first and second frustoconical apertures maintains a temperature difference between said freezer compartment and said chilled compartment.

2. The storage container of claim 1, wherein the storage container is configured for receiving within a housing container, said housing container configured with solid side walls and a lid, and wherein said lid admits access to removable covers of the storage container.

3. The storage container of claim 1, said basin comprises an ambient compartment neighboring said chilled compartment with an ambient partition wall disposed therebetween.

4. The storage container of claim 2, comprising external walls that comprise a base member, a right side wall, a left side wall, a front wall a back wall, at least one removable cover, wherein said external walls and said at least one removable cover and said partition walls are made of a thermally insulating material.

5. The storage container of claim 4, wherein the base member, and the walls of the storage container and at least the freezer partition wall and the chill partition wall are configured for foolproof assembly at a pre-designed configuration.

6. The storage container of claim 3, wherein the cooling chamber comprises a top cover extending over at least a portion of a cooling chamber space that is defined between the freezer partition wall, and the chill partition wall and a cooling medium support within said cooling chamber.

7. The storage container of claim 6, wherein the top cover of the cooling chamber is configured with a child-proof arrangement, so as to prevent or reduce the likelihood of a child displacing the top cover between an open position at which the top cover can be opened to facilitate access into the cooling chamber space, and a closed position.

8. The storage container of claim 6, wherein the cooling medium support within the cooling chamber is spaced apart from the base member of the storage container.

9. The storage container of claim 6, wherein the cooling chamber is configured with one or two lateral flow paths, extending between a bottom space below the cooling medium support, and a top portion, above the cooling medium support.

10. The storage container of claim 6, wherein a space below the cooling medium support is configured with air flow apertures, facilitating air flow between the freezer compartment and the chilled compartment.

11. The storage container of claim 2, wherein when said cooling medium is received within the cooling chamber the cooling chamber is a lower-most, sub-zero temperature zone (T° Cc); the freezer compartment is configured as a sub-zero temperature zone (T° Fc); the chilled compartment is configured as a chilled temperature zone (T° CHc); and the ambient compartment is configured as an ambient temperature zone (T° Ac); wherein T° Cc<T° Fc<T° CHc<T° Ac.

12. The storage container of claim 2, wherein the ambient partition wall is configured with throughgoing apertures configured for air circulation between the chilled compartment and the ambient compartment.

13. The storage container of claim 6, wherein the cooling medium support within the cooling chamber is further configured with refrigerator apertures extending between the cooling chamber space towards a space below the cooling medium support, facilitating air flow in direction from the cooling chamber space towards said space below the cooling medium support.

14. The storage container of claim 5, wherein walls of the container are assembled over the base member at a preset arrangement, by a foolproof arrangement, wherein mating edges of the walls and the base member comprise one or more projections configured at one or both of the walls and the base member, and the other one or both of the walls and the base member comprises respective indentions, in register with the projections, configured for unidirectional true positioning of said walls over the base member.

15. The storage container of claim 5, wherein any one or more of the front wall, the back wall and the base member of the storage container are configured with a foolproof assembly arrangement, configured for unidirectional, true positioning, of the cooling chamber within the interior space.

16. The storage container of claim 5, wherein any one or more of the partition walls is configured, at one or more of a bottom edge and side edges thereof, with depressions and/or projections disposed in register with opposite ones of depressions and/or projections configured at a bottom edge of the front wall and the back wall and the base wall, respectively.

17. A cooler container kit comprising a housing container configured with solid side walls and a lid, and a storage container of claim 1 snugly receivable with said housing container and where the lid admits access to the removable covers of the storage container.

* * * * *